US009575423B2

(12) United States Patent
Azuma et al.

(10) Patent No.: US 9,575,423 B2
(45) Date of Patent: Feb. 21, 2017

(54) ELECTROPHOTOGRAPHIC PHOTOSENSITIVE MEMBER

(71) Applicant: KYOCERA Document Solutions Inc., Osaka (JP)

(72) Inventors: Jun Azuma, Osaka (JP); Kensuke Okawa, Osaka (JP); Akihiko Ogata, Osaka (JP); Takahiro Oki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/641,193

(22) Filed: Mar. 6, 2015

(65) Prior Publication Data

US 2015/0253682 A1 Sep. 10, 2015

(30) Foreign Application Priority Data

| | | |
|---|---|---|
| Mar. 7, 2014 | (JP) | 2014-044634 |
| Mar. 10, 2014 | (JP) | 2014-045867 |
| Mar. 10, 2014 | (JP) | 2014-045868 |
| Mar. 25, 2014 | (JP) | 2014-062019 |

(51) Int. Cl.
*G03G 5/047* (2006.01)
*G03G 5/06* (2006.01)
(Continued)

(52) U.S. Cl.
CPC ..... *G03G 5/047* (2013.01); *G03G 5/04* (2013.01); *G03G 5/043* (2013.01); *G03G 5/0507* (2013.01); *G03G 5/0564* (2013.01); *G03G 5/0605* (2013.01); *G03G 5/0609* (2013.01); *G03G 5/0612* (2013.01); *G03G 5/0614* (2013.01);
(Continued)

(58) Field of Classification Search
CPC .. G03G 5/0564; G03G 5/0696; G03G 5/0605; G03G 5/0614; G03G 5/14704; G03G 5/047; G03G 5/0668
See application file for complete search history.

(56) References Cited

U.S. PATENT DOCUMENTS 3,954,466 A * 5/1976 Beatty ..... G03G 5/0503 427/76
4,574,114 A 3/1986 Tsutsumi et al.
(Continued)

FOREIGN PATENT DOCUMENTS

JP S59-119357 A 7/1984
JP 11295910 A * 10/1999
(Continued)

OTHER PUBLICATIONS

English language machine translation of JP 11-295910 (Oct. 1999).*
(Continued)

*Primary Examiner* — Christopher Rodee
(74) *Attorney, Agent, or Firm* — Studebaker & Brackett PC

(57) ABSTRACT

An electrophotographic photosensitive member has a photosensitive layer. The photosensitive layer is a multi-layer photosensitive layer having a charge transport layer being an outermost layer or a single-layer photosensitive layer. The amount of silica particles contained in the photosensitive layer is at least 0.5 parts by mass and no greater than 15 parts by mass relative to 100 parts by mass of a binder resin contained in the photosensitive layer.

16 Claims, 2 Drawing Sheets

(51) Int. Cl.
*G03G 5/05* (2006.01)
*G03G 5/04* (2006.01)
*G03G 5/043* (2006.01)

(52) U.S. Cl.
CPC ..... *G03G 5/0668* (2013.01); *G03G 5/0672* (2013.01); *G03G 5/0696* (2013.01)

(56) References Cited

U.S. PATENT DOCUMENTS

| | | | | | |
|---|---|---|---|---|---|
| 5,096,795 | A * | 3/1992 | Yu | G03G 5/0503 | 430/58.8 |
| 5,707,767 | A * | 1/1998 | Yu | G03G 5/043 | 430/56 |
| 6,911,288 | B2 * | 6/2005 | Goodbrand | G03G 5/0507 | 399/159 |
| 7,081,234 | B1 * | 7/2006 | Qi | C08K 9/06 | 399/159 |
| 7,655,373 | B2 * | 2/2010 | Dinh | G03G 5/14704 | 430/119.71 |
| 7,700,251 | B2 * | 4/2010 | Nakai | G03G 5/047 | 399/159 |
| 7,858,278 | B2 | 12/2010 | Ikuno et al. | | |
| 2006/0068307 | A1 * | 3/2006 | Itami | G03G 5/0507 | 430/58.05 |
| 2006/0115761 | A1 * | 6/2006 | Itami | G03G 5/0507 | 430/122.1 |
| 2007/0269729 | A1 | 11/2007 | Ikuno et al. | | |
| 2007/0281227 | A1 * | 12/2007 | Maruo | G03G 5/047 | 430/58.05 |

FOREIGN PATENT DOCUMENTS

| | | | |
|---|---|---|---|
| JP | 2000314969 | A * | 11/2000 |
| JP | 2002287387 | A * | 10/2002 |
| JP | 2003-316203 | A | 11/2003 |
| JP | 2004-077870 | A | 3/2004 |
| JP | 2004-117994 | A | 4/2004 |
| JP | 2004-144897 | A | 5/2004 |
| JP | 2005196106 | A * | 7/2005 |
| JP | 2005208597 | A * | 8/2005 |
| JP | 2005-289877 | A | 10/2005 |
| JP | 2007-310153 | A | 11/2007 |
| JP | 2007-310155 | A | 11/2007 |
| JP | 2011-027767 | A | 2/2011 |
| JP | 2012103619 | A * | 5/2012 |
| JP | 2013-047751 | A | 3/2013 |

OTHER PUBLICATIONS

English language machine translation of JP 2002-287397 (Oct. 2002).*
English language machine translation of JP 2005-196106 (Jul. 2005).*
English language machine translation of JP 2005-208597 (Aug. 2005).*
English language machine translation of JP 2012-103619 (May 2012).*

* cited by examiner

ELECTROPHOTOGRAPHIC PHOTOSENSITIVE MEMBER

INCORPORATION BY REFERENCE

The present application claims priority under 35 U.S.C. §119 to Japanese Patent Applications No. 2014-44634, filed Mar. 7, 2014, No. 2014-45867 filed Mar. 10, 2014, No. 2014-45868 filed Mar. 10, 2014, and No. 2014-62019 filed Mar. 25, 2014. The contents of these applications are incorporated herein by reference in their entirety.

BACKGROUND

The present disclosure relates to electrophotographic photosensitive members.

An electrophotographic photosensitive member may be used as an image bearing member of an electrophotographic printer or a multifunction peripheral. Electrophotographic organic photosensitive members have advantages of being environmentally friendly and easy to manufacture. Typically, an electrophotographic organic photosensitive member includes a conductive substrate and a photosensitive layer disposed directly or indirectly on the substrate. The photosensitive layer contains a charge generating material, a charge transport material, and an organic material (a resin, for example) for binding the charge generating material and the charge transport material.

One known charge transport material is a butadienylbenzene amine derivative. The butadienylbenzene amine derivative is excellent in the hole transport function.

SUMMARY

An electrophotographic photosensitive member according to the present disclosure includes a photosensitive layer. The photosensitive layer is: a multi-layer photosensitive layer including a stack of a charge generating layer containing a charge generating material and a charge transport layer containing a charge transport material, a binder resin, and silica particles, the charge transport layer being an outermost layer; or a single-layer photosensitive layer containing a charge generating material, a charge transport material, a binder resin, and silica particles. The silica particles are contained in the photosensitive layer in an amount of at least 0.5 parts by mass and no greater than 15 parts by mass relative to 100 parts by mass of the binder resin.

DETAILED DESCRIPTION

The following explains an embodiment of the present disclosure. However, the present disclosure is in no way limited to the embodiment below, and various alterations may be made to implement the present disclosure within the scope of the objective of the present disclosure. Note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Also, in an X-ray diffraction spectrum with respect to characteristic X-rays of CuKα, a "major peak" refers to a peak having highest or second highest intensity among diffraction peaks at Bragg angles 2θ±0.2° within a range of 3° to 40°.

A photosensitive member according to the present embodiment is an electrophotographic photosensitive member having a photosensitive layer. The photosensitive layer contains a charge generating material, a charge transport material, a binder resin, and silica particles (more specifically, silica particulates).

The photosensitive layer of the photosensitive member according to the present disclosure is a multi-layer photosensitive layer or a single-layer photosensitive layer. The multi-layer photosensitive layer contains a charge generating material and a charge transport material in separate layers. The multi-layer photosensitive layer includes a stack of: a charge generating layer containing a charge generating material; and a charge transport layer containing a charge transport material, a binder resin, and silica particulates. A single-layer photosensitive layer contains a charge generating material and a charge transport material in the same layer. The single-layer photosensitive layer is a single layer containing a charge generating material, a charge transport material, a binder resin, and silica particulates.

<Multi-Layer Photosensitive Member>

Figure 1A:
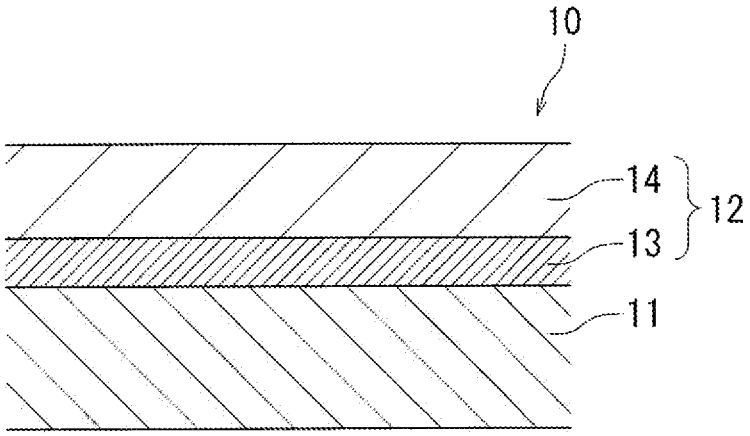
FIG. 1A shows a cross-sectional structure of a multi-layer electrophotographic photosensitive member according to an embodiment of the present disclosure.
Figure 1B:
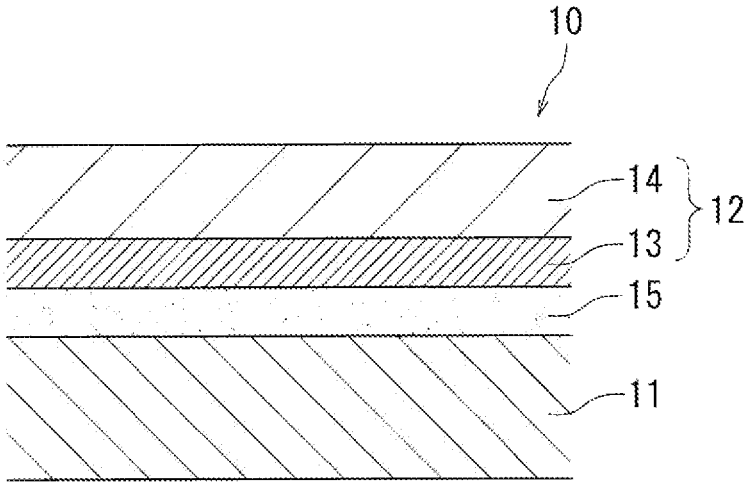
FIG. 1B shows a cross-sectional structure of another multi-layer electrophotographic photosensitive member according to the embodiment of the present disclosure.

With reference to FIGS. 1A and 1B, the following explains a photosensitive member that includes a multi-layer photosensitive layer (hereinafter, referred to as a multi-layer photosensitive member 10).

As illustrated in FIG. 1A, the multi-layer electrophotographic photosensitive member 10 includes a substrate 11 and a multi-layer photosensitive layer 12. The multi-layer photosensitive layer 12 is disposed directly on the substrate 11, for example. The multi-layer photosensitive layer 12 further includes a charge generating layer 13 (lower layer) and a charge transport layer 14 (upper layer). The charge generating layer 13 contains a charge generating material. The charge transport layer 14 contains a charge transport material, a binder resin, and silica particulates.

The multi-layer photosensitive member 10 according to the present embodiment includes the charge generating layer 13 and the charge transport layer 14 stacked on the substrate 11 in the order stated. The charge transport layer 14 is the outermost layer of the multi-layer photosensitive member 10. This configuration is effective to allow the charge generating layer 13 to be thin. More specifically, since the charge transport layer 14 is the outermost layer of the multi-layer photosensitive member 10, the charge generating layer 13 is protected from abrasion and defects. This configuration is also effective to increase the longevity of the charge generating layer 13. The charge generating layer 13 may be thinner than the charge transport layer 14.

As shown in FIG. 1B, the multi-layer photosensitive member 10 may additionally include an intermediate layer 15 between the substrate 11 and the multi-layer photosensitive layer 12. In this configuration, the multi-layer photosensitive layer 12 is disposed indirectly on the substrate 11 via the intermediate layer 15.

The thickness of the charge generating layer 13 is preferably at least 0.01 μm and no greater than 5 μm, and more preferably at least 0.1 μm and no greater than 3 μm. In addition, the thickness of the charge transport layer 14 is preferably at least 2 μm and no greater than 100 μm, and more preferably at least 5 μm and no greater than 50 μm.

<Single-Layer Photosensitive Member>

Figure 2A:
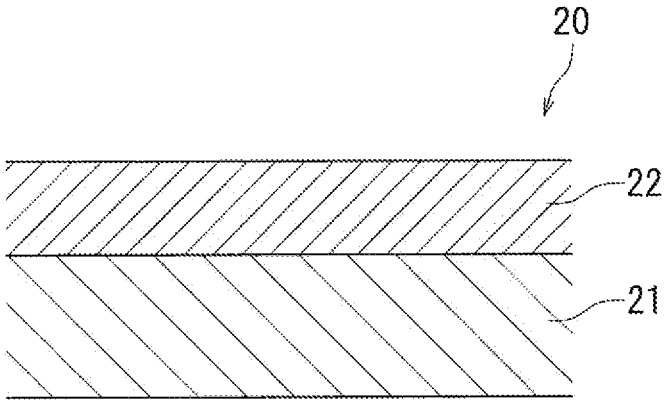
FIG. 2A shows a cross-sectional structure of a single-layer electrophotographic photosensitive member according to the embodiment of the present disclosure.
Figure 2B:
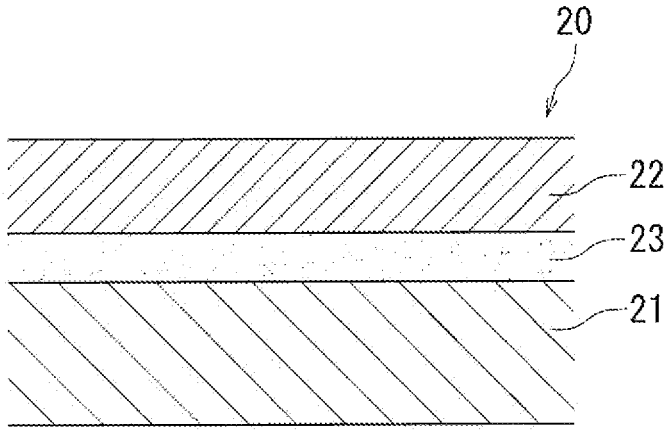
FIG. 2B shows a cross-sectional structure of another single-layer electrophotographic photosensitive member according to the embodiment of the present disclosure.

With reference to FIGS. 2A and 2B, the following explains a photosensitive member having a single-layer photosensitive layer (hereinafter, referred to as a single-layer photosensitive member 20).

As illustrated in FIG. 2A, the single-layer photosensitive member 20 includes a substrate 21 and a single-layer photosensitive layer 22. The single-layer photosensitive layer 22 is disposed directly on the substrate 21, for example. The single-layer photosensitive layer 22 is a single layer containing a charge generating material, a charge transport material, and a binder resin.

As shown in FIG. 2B, the single-layer photosensitive member 20 may additionally include an intermediate layer 23 between the substrate 21 and single-layer photosensitive layer 22. In this configuration, the single-layer photosensitive layer 22 is disposed indirectly on the substrate 21 via the intermediate layer 23.

The thickness of the single-layer photosensitive layer 22 is preferably at least 5 μm and no greater than 100 μm, and more preferably at least 10 μm and no greater than 50 μm.

The electrophotographic photosensitive member (single- or multi-layer photosensitive member) according to the present embodiment preferably has the photosensitive layer (single- or multi-layer photosensitive layer) as the outermost layer. The electrophotographic photosensitive member having such a configuration is effective to reduce or prevent occurrences of image deletion. In addition, an electrophotographic photosensitive member having such a configuration is easy to manufacture at low cost.

In order to improve the electrophotographic photosensitive member in terms of the sensitivity in a low-temperature and low-humidity environment, the abrasion resistance, and the resistance to oil cracking, the charge transport layer of the multi-layer photosensitive member or the single-layer photosensitive layer of the single-layer photosensitive member preferably contains silica particles in an amount of at least 0.5 parts by mass and no greater than 15 parts by mass relative to 100 parts by mass of the binder resin. The silica particles are preferably silica particulates.

The electrophotographic photosensitive member according to the present embodiment contains silica particles in the outermost layer of the photosensitive layer. For example, in the case where the electrophotographic photosensitive member according to the present embodiment is the multi-layer photosensitive member 10 shown in FIG. 1A, the charge transport layer 14 contains silica particles. In the case where the electrophotographic photosensitive member according to the present embodiment is the single-layer photosensitive member 20 shown in FIG. 2A, the single-layer photosensitive layer 22 contains silica particles.

In the electrophotographic photosensitive member according to the present embodiment, the charge transport layer or the single-layer photosensitive layer contains silica particles in an amount of at least 0.5 parts by mass and no greater than 15.0 parts by mass relative to 100.0 parts by mass of the binder resin. The presence of an appropriate amount of silica particles in the outermost layer of the photosensitive layer facilitates the resulting photosensitive layer to have an excellent resistance to abrasion and to oil cracking.

The use of silica particles tends to improve the resulting photosensitive layer in the abrasion resistance and the oil crack resistance, as compared with the use of particles other than silica particles (more specifically, particles of zinc oxide, titanium oxide, tin oxide, antimony oxide, indium oxide, bismuth oxide, indium oxide doped with tin, tin oxide doped with antimony or tantalum, zirconium oxide, and so the like). Silica particles can be manufactured at low cost. Silica particles can be readily subjected to surface treatment and particle size adjustment.

In order to improve the abrasion resistance and the oil crack resistance, surface treated silica particles are preferred. A surface treatment agent suitable for treating silica particles include hexamethyldisilazane, N-methyl-hexamethyldisilazane, hexamethyl-N-propyldisilazane, dimethyldichlorosilane, and polydimethylsiloxane. Among the surface treatment agents listed, hexamethyldisilazane is particularly preferable. Hexamethyldisilazane is excellent in reactivity with hydroxyl groups at the surface of the silica particles. The surface treatment of the silica particles with hexamethyldisilazane reduces the number of hydroxyl groups present at the surface of the silica particles and thus can restrict degradation of the electrical characteristics of the silica particles due to moisture (humidity). In addition, hexamethyldisilazane is a surface treatment agent that is less prone to dissociation from the surface of the silica particles. Restricting dissociation of the surface treatment agent is effective to restrict charge trapping by the dissociated surface treatment agent (and thus to restrict the sensitivity reduction caused by charge trapping).

The diameter of the silica particles (number average primary particle diameter) is preferably at least 7 nm and no greater than 50 nm. With the particle diameter of at least 7 nm, the silica particles tend to have a high abrasion resistance and a high oil crack resistance. In addition, with the particle diameter of no greater than 50 nm, the silica particles tend to be highly dispersible in the binder resin.

In order to improve the electrophotographic photosensitive member in terms of the sensitivity in a low-temperature and low-humidity environment, the abrasion resistance, and the oil crack resistance, the charge transport layer of the multi-layer photosensitive member or the single-layer photosensitive layer of the single-layer photosensitive member preferably contains, in addition to the hole transport material, a compound represented by any one of General Formulae (1) to (3).

(1)

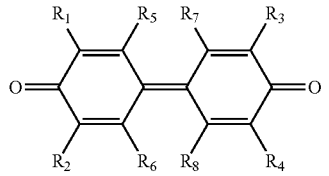

In General Formula (1), $R_1$ to $R_8$ each independently represent a hydrogen atom, an alkoxy group having 1 to 8 carbon atoms, a phenyl group, or an optionally substituted alkyl group having 1 to 8 carbon atoms.

(2)

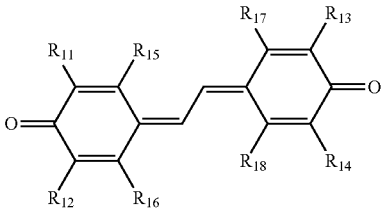

In General Formula (2), $R_{11}$ to $R_{18}$ each independently represent a hydrogen atom, an alkoxy group having 1 to 8 carbon atoms, a phenyl group, or an optionally substituted alkyl group having 1 to 8 carbon atoms.

(3)

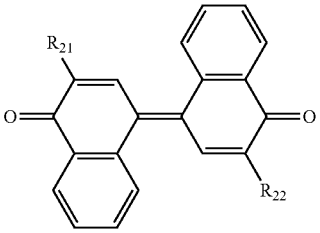

In General Formula (3), $R_{21}$ to $R_{22}$ each independently represent a hydrogen atom, an alkoxy group having 1 to 8 carbon atoms, a phenyl group, or an optionally substituted alkyl group having 1 to 8 carbon atoms.

Preferable examples of the compound represented by General Formula (1) include compounds represented by either one of the formulae (ETM-1) and (ETM-2) below.

(ETM-1)

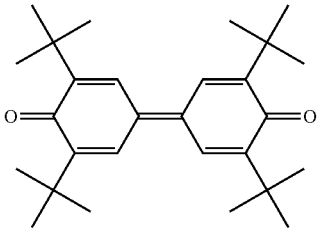

(ETM-2)

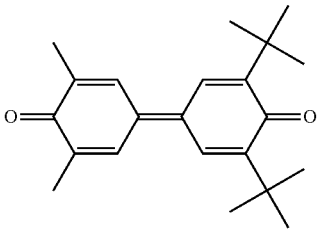

Preferable examples of the compound represented by General Formula (2) include compounds represented by Formulae (ETM-3) and (ETM-4) below.

(ETM-3)

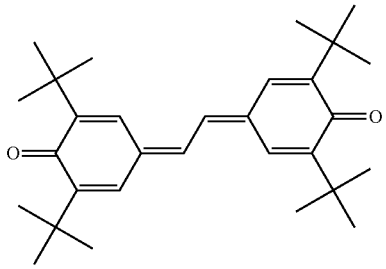

(ETM-4)

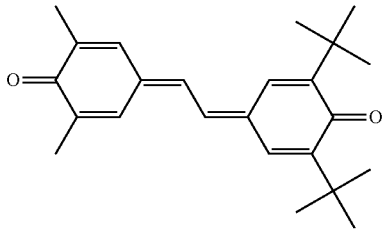

Preferable examples of the compound represented by General Formula (3) include a compound represented by Formula (ETM-5) below.

(ETM-5)

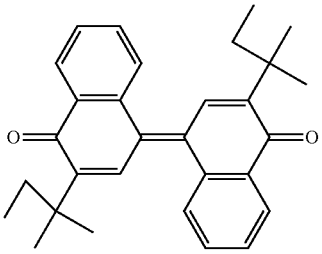

In order to improve the electrophotographic photosensitive member in terms of the electrical characteristics and the abrasion resistance, the charge transport layer of the multilayer photosensitive member or the single-layer photosensitive layer of the single-layer photosensitive member preferably contains a biphenyl derivative or a phenanthrene derivative. The presence of a biphenyl derivative or a phenanthrene derivative in the charge transport layer or the single-layer photosensitive layer can improve the crack resistance of the electrophotographic photosensitive member. The crack resistance improves presumably because the biphenyl derivative or the phenanthrene derivative selectively mixes with the binder resin to assist the binder resin to effectively carry out its function. The presence of a biphenyl derivative or a phenanthrene derivative in the charge transport layer or the single-layer photosensitive layer is assumed to ensure the electrophotographic photosensitive member to have excellent abrasion resistance and electrical characteristics.

The amount of the biphenyl derivative or the phenanthrene derivative in the charge transport layer or the single-layer photosensitive layer is preferably at least 0.1 parts by mass and no greater than 15 parts by mass with respect to 100 parts by mass of the binder resin.

As the biphenyl derivative or the phenanthrene derivative, compounds represented by Formulae (ADD-1) to (ADD-8) below are particularly preferable.

(ADD-1)

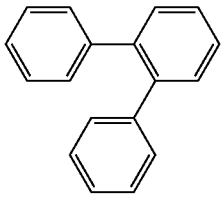

(ADD-2)

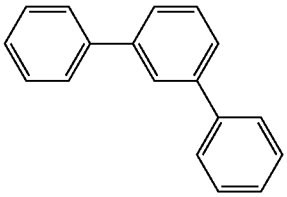

(ADD-3)

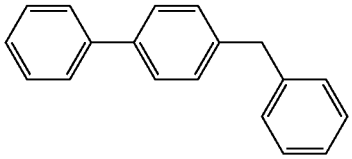

(ADD-4)

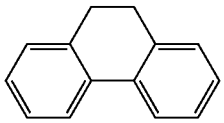

(ADD-5)

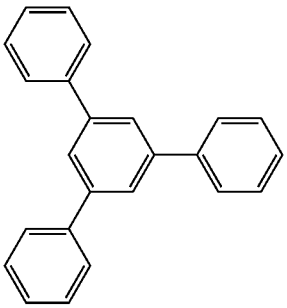

(ADD-6)

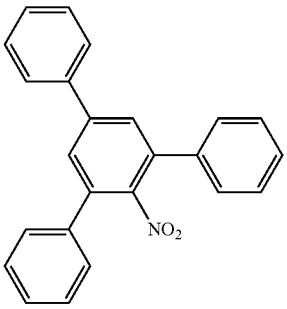

-continued (ADD-7)

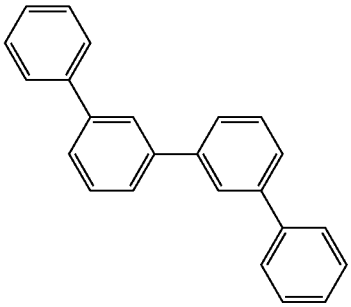

(ADD-8)

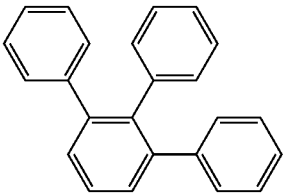

In order to improve the electrophotographic photosensitive member in terms of the electrical characteristics and the abrasion resistance, the charge transport layer of the multilayer photosensitive member or the single-layer photosensitive layer of the single-layer photosensitive member preferably contains a phthalocyanine pigment for the reason detailed below. That is, a portion of the electrophotographic photosensitive member not exposed to light in the exposure process for image formation tends to generate charges of reversed polarity. The charges of reversed polarity may not be readily and fully eliminated in the subsequent static elimination process. Yet, when a phthalocyanine pigment is present in the charge transport layer or the single-layer photosensitive layer of the photosensitive member, the phthalocyanine pigment is assumed to absorb the energy of exposure light and generate charges that cancel out the charges of the reversed polarity in the static elimination process. Therefore, the presence of a phthalocyanine pigment in the charge transport layer or the single-layer photosensitive layer of the photosensitive member is expected to improve the electrical characteristics of the photosensitive member. Note that both the charge generating layer and the charge transport layer may contain a phthalocyanine pigment. In such a case, the phthalocyanine pigment contained in the charge generating layer and the phthalocyanine pigment contained in the charge transport layer may be of the same phthalocyanine pigment or different phthalocyanine pigments.

The charge transport layer preferably contains at least one phthalocyanine pigment selected from among a metal-free phthalocyanine pigment (τ-type or X-type), a titanyl phthalocyanine pigment (α-type or Y-type), a hydroxygallium phthalocyanine pigment (V-type), a chlorogallium phthalocyanine pigment (II-type), and a copper phthalocyanine pigment (ϵ-type). In order to improve the photosensitive member in terms of the electrical characteristics and the abrasion resistance, a particularly preferable phthalocyanine pigment is: TiOPc (Y-type titanyl phthalocyanine) that at least exhibits a peak at 27.2° among diffraction peaks at Bragg angles 2θ±0.2° with respect to characteristic X-rays of CuKα; TiOPc (α-type titanyl phthalocyanine) that at least exhibits a peak at 28.6 among diffraction peaks at Bragg angles 2θ±0.2° with respect to characteristic X-rays of CuKα; or a metal-free phthalocyanine.

The amount of the phthalocyanine pigment contained in the charge transport layer is preferably at least 0.001 parts by mass and no greater than 1.0 parts by mass with respect to 100 parts by mass of the binder resin contained in the charge transport layer. When the amount of the phthalocyanine pigment is less than 0.001 parts by mass, the charges of reversed polarity present in a non-exposed portion of the photosensitive member may not be effectively canceled out. On the other hand, when the amount of the phthalocyanine pigment exceeds 1.0 part by mass, the charge transport layer absorbs exposure light, interfering with the light to be absorbed by the charge generating layer.

In order to improve the electrophotographic photosensitive member in terms of the electrical characteristics, the abrasion resistance, and the surface appearance, the coefficient of kinetic friction at the surface of the photosensitive layer is preferably no greater than 0.25 and that the charge transport layer of the multi-layer photosensitive member or the single-layer photosensitive layer of the single-layer photosensitive member preferably contains a leveling agent. In order to improve the electrophotographic photosensitive member in terms of the electrical characteristics, the abrasion resistance, and the surface appearance, the coefficient of kinetic friction at the surface of the photosensitive layer is more preferably no greater than 0.23. As the leveling agent, a silicone oil having a siloxane backbone is particularly preferable. In order to improve the photosensitive member in terms of the abrasion resistance, the amount of the leveling agent contained in the charge transport layer or the single-layer photosensitive layer is preferably at least 0.5 parts by mass and no greater than 0.9 parts by mass relative to 100 parts by mass of the binder resin.

The leveling agent is used for example to restrict occurrences of defects on the coating surface (for example, Benard cells, creating, or cissing). The leveling agent may be dissolved in a solvent before use. The use of a leveling agent can ensure the coating to have a uniform surface tension. The present inventors have found that a combined use of a leveling agent and silica particulates can reduce the coefficient of kinetic friction at the surface of the photosensitive layer and thus improve the abrasion resistance. More specifically, a photosensitive layer containing a leveling agent and silica particles is excellent in electrical characteristics. In addition, by ensuring the coefficient of kinetic friction at the surface of a photosensitive layer to be no greater than 0.25, the photosensitive layer can be ensured to have an excellent abrasion resistance. The presence of a leveling agent in the photosensitive layer can help reduce the coefficient of kinetic friction at the surface of the photosensitive layer to 0.25 or less. With the coefficient of kinetic friction at the surface of the photosensitive layer being no greater than 0.25, the abrasion resistance of the photosensitive layer (and thus the durability of the electrophotographic photosensitive member) improves. When the photosensitive layer of an electrophotographic photosensitive member contains a leveling agent and silica particles, an image forming apparatus that includes the electrophotographic photosensitive member can form high quality images over a long time. For easy manufacture of a highly durable electrophotographic photosensitive member, the coefficient of kinetic friction at the surface of the photosensitive layer is preferably at least 0.10 and no greater than 0.25.

Preferable examples of the leveling agent include silicone leveling agents, acrylic acid-based leveling agents, and fluorine-containing leveling agents, and silicone leveling agents are particularly preferable. Preferable examples of silicone leveling agents include a silicone oil.

Preferable silicone oil has a siloxane backbone, and compounds represented by Formulae (4) and (5) below are preferable.

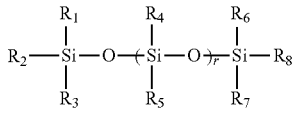

(4)

In Formula (4), $R_1$ to $R_8$ each independently represent a hydrogen atom, an alkyl group having 1 to 6 carbon atoms, a phenyl group, an alkoxy group having 1 to 6 carbon atoms, a glycidyl group, a carboxyl group, or an amino group. In Formula (4), r represents an integer equal to or greater than 1. The integer represented by r in Formula (4) is preferably equal to or greater than 10, and more preferably equal to or greater than 20. When the integer represented by r in Formula (4) is equal to or greater than 10, the molecular weight of the compound represented by Formula (4) is sufficiently large to improve the abrasion resistance and the surface appearance of the photosensitive layer.

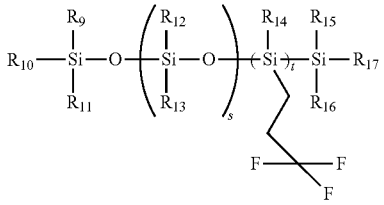

(5)

In Formula (5), $R_1$ to $R_{17}$ each independently represent a hydrogen atom, an alkyl group having 1 to 6 carbon atoms, a phenyl group, an alkoxy group having 1 to 6 carbon atoms, a glycidyl group, a carboxyl group, or an amino group. In Formula (5), s and t each independently represents an integer equal to or greater than 1. The integers represented by s and t in Formula (5) are each preferably equal to or greater than 10. When each integer represented by s or t in Formula (5) is equal to or greater than 10, the molecular weight of the compound represented by Formula (5) is sufficiently large to improve the abrasion resistance and the surface appearance of the photosensitive layer.

<Common Components>

The following explains components that are common to both the single-layer photosensitive member and the multi-layer photosensitive member.

[Substrate]

The electrophotographic photosensitive member according to the present embodiment includes a substrate that is electrically conductive at least at the surface. The substrate may be formed from a conductive material entirely or partially. For example, the substrate may be made from an insulating material (for example, plastic material or glass) having a surface coated with a conductive material (by deposition, for example). Examples of conductive materials include metals, such as aluminum, iron, copper, tin, platinum, silver, vanadium, molybdenum, chromium, cadmium, titanium, nickel, palladium, indium, stainless steel, and brass, and alloys of any of these metals. The conductive materials listed above may be used singly or in combination of two or more.

In particular, a substrate made from aluminum or an aluminum alloy is preferable. The electrophotographic photosensitive member having such a configuration ensures excellent migration of charges from the photosensitive layer to the substrate, so that favorable image formation can be expected.

The shape of the substrate is not specifically limited. For example, the substrate may have the shape of a sheet or drum, depending on the structure of an image forming apparatus to which the electrophotographic photosensitive member is applied. Note that the substrate preferably has a sufficient mechanical strength for use.

[Charge Generating Material]

The electrophotographic photosensitive member according to the present embodiment contains a charge generating material in the charge generating layer of the multi-layer photosensitive member or in the single-layer photosensitive layer of the single-layer photosensitive member. Preferable examples of the charge generating material include X-form metal-free phthalocyanine (x-$H_2$Pc), Y-form titanyl phthalocyanine (Y—TiOPc), perylene pigment, bisazo pigment, dithioketopyrrolopyrrole pigment, metal-free naphthalocyanine pigment, metal naphthalocyanine pigment, squaraine pigment, tris-azo pigment, indigo pigment, azulenium pigment, cyanine pigment, an inorganic photoconductive material (more specifically, selenium, selenium-tellurium, selenium-arsenic, cadmium sulfide, amorphous silicon, or the like), pyrylium salt, anthanthrone-based pigment, triphenylmethane-based pigment, threne-based pigment, toluidine-based pigment, pyrazoline-based pigment, and quinacridone-based pigment.

One of the charge generating materials having desired absorption wavelengths in a desired wavelength range may be used singly. Alternatively, two or more of the charge generating materials may be used in combination to form an electrophotographic photosensitive member having the sensitivity within a desired wavelength range. For example, for an image forming apparatus employing a digital optical system (for example, a laser beam printer or facsimile machine employing a light source such as a semiconductor laser), an electrophotographic photosensitive member having a sensitivity in a wavelength range of 700 nm or longer is preferable. A charge generating material preferable for forming such an electrophotographic photosensitive member is a phthalocyanine-based pigment (for example, X-type metal-free phthalocyanine (x-$H_2$Pc) or Y-type titanyl phthalocyanine (Y—TiOPc)). The crystal structure of the phthalocyanine-based pigment is not specifically limited and is optional. For an image forming apparatus employing a short-wavelength laser light source, an electrophotographic photosensitive member having a sensitivity in a short wavelength range (for example, a range from 350 nm to 550 nm) is preferable. A charge generating material preferable for forming such an electrophotographic photosensitive member is an anthanthrone-based pigment or a perylene-based pigment.

Examples of the charge generating material include phthalocyanine-based pigments represented by Formulae (CGM-1) to (CGM-4) below.

(CGM-1)

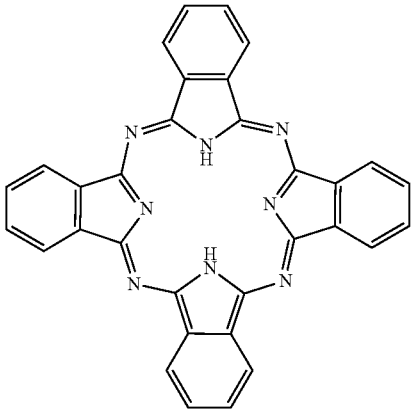

(CGM-2)

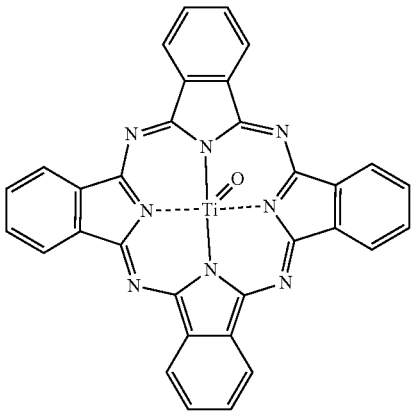

(CGM-3)

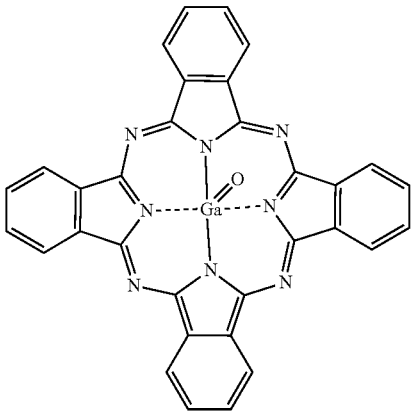

-continued (CGM-4)

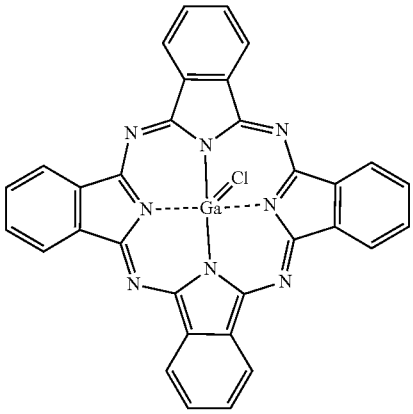

The amount of the charge generating material contained in the multi-layer photosensitive member is preferably at least 5 parts by mass and no greater than 1,000 parts by mass relative to 100 parts by mass of the resin contained in the charge generating layer (more specifically, a base resin, which will be described later), and more preferably at least 30 parts by mass and no greater than 500 parts by mass.

The amount of the charge generating material contained in the single-layer photosensitive member is preferably at least 0.1 parts by mass and no greater than 50 parts by mass relative to 100 parts by mass of the resin contained in the single-layer photosensitive layer (more specifically, the binder resin, which will be described later), and more preferably at least 0.5 parts by mass and no greater than 30 parts by mass.

[Charge Transport Material]

Examples of charge transport materials include a hole transport material, which is a substance having an ability of transporting holes (positive charges), and electron transport material, which is a substance having ability of transporting electrons (negative charges). The electrophotographic photosensitive member according to the present embodiment may contain both a hole transport material and an electron transport material in the charge transport layer of the multi-layer photosensitive member or in the single-layer photosensitive layer of the single-layer photosensitive member.

When an electron transport material and a hole transport material are both contained and the amount of the electron transport material is too small, the electron transport material may fail to transport holes. For example, when the multi-layer photosensitive member 10 shown in FIG. 1A has a charge generating layer 13 that is extremely thin, all the electrons generated in the charge generating layer 13 tend to migrate to the substrate 11 (conductive substrate). Consequently, the charge transport layer 14 only transports holes generated in the charge generating layer 13. In addition, the electron transport material contained in the charge transport layer 14 contributes to the transport of charges (holes) by assisting the hole transport material.

In the single-layer photosensitive member 20 shown in FIG. 2A or 2B, the single-layer photosensitive layer 22 generates holes and electrons in a large part from the surface to the intrinsic portion (bulk) of the single-layer photosensitive layer 22. In the single-layer photosensitive layer 22, the hole transport material transports holes and the electron transport material transport electrons.

(Hole Transport Material)

The hole transport material preferably contains a compound having at least two styryl groups and at least one aryl group. Preferable example of the compound contained in the hole transport material include compounds (each of which is a styryl-triaryl derivative) represented by General Formulae (6) to (9) below.

An arylamine group included in a styryl-triarylamine derivative is effective to improve the electrical characteristics of the photosensitive member. More specifically, the styryl-triarylamine derivative is presumed to reduce the ionization potential of the photosensitive member (and thus the energy gap for transferring charges between the styryl-triarylamine derivative and the charge generating material), improving the charge transport efficiency. Improving the charge transport efficiency is assumed to be effective to reduce the residual potential on the photosensitive member. In particular, a styryl-triarylamine derivative contained, as a hole transport material, in the charge transport layer of the multi-layer electrophotographic photosensitive tends to facilitate migration of charges at a boundary between the charge generating layer and the charge transport layer.

To improve the dispersibility of a styryl-triarylamine derivative in the charge transport layer 14, the amount of the styryl-triarylamine derivative is preferably at least 30 parts by mass and no greater than 60 parts by mass relative to 100 parts by mass of the resin contained in the charge transport layer 14 (more specifically, the binder resin, which will be described later), and more preferably at least 30 parts by mass and no greater than 55 parts by mass. Improving the dispersibility of the styryl-triarylamine derivative in the charge transport layer 14 is assumed to be effective to improve the electrical characteristics of the electrophotographic photosensitive member. The charge transport layer 14 may contain, in addition to the styryl-triarylamine derivative, a different hole transport material other than the styryl-triarylamine derivative. In such a case, the amount of the different hole transport material is preferably at least 1 part by mass and no greater than 100 parts by mass relative to the 100 parts by mass of the binder resin.

(6)

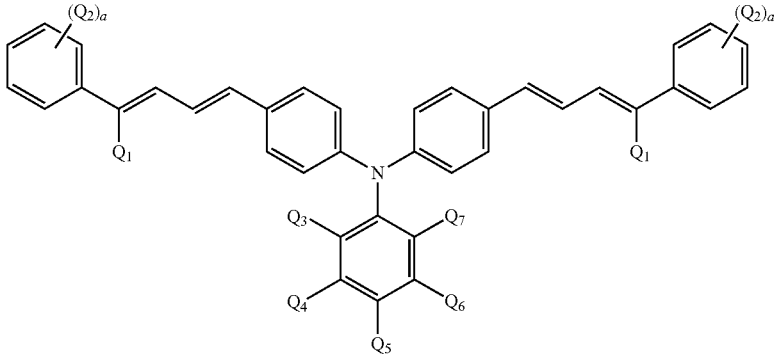

In Formula (6), $Q_1$ to $Q_7$ each independently represent a hydrogen atom, an alkoxy group having 1 to 8 carbon atoms, a phenyl group, and an alkyl group having 1 to 8 carbon atoms. Among the groups represented by $Q_3$ to $Q_7$, adjacent groups may be bonded together to form a ring. In the formula (6), a represents an integer from 0 to 5.

(7)

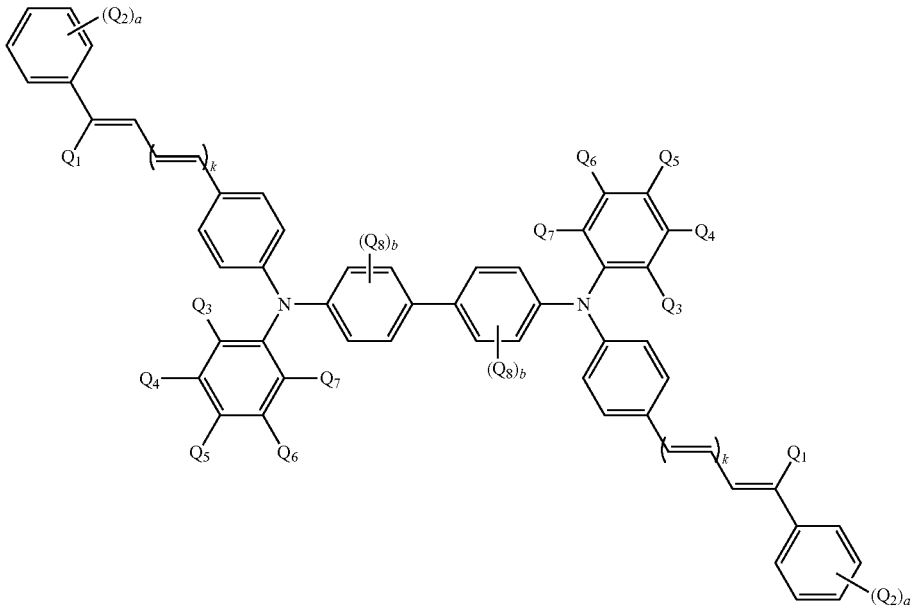

In Formula (7), $Q_1$ to $Q_8$ each independently represent a hydrogen atom, an alkoxy group having 1 to 8 carbon atoms, a phenyl group, and an alkyl group having 1 to 8 carbon atoms. Among the groups represented by $Q_3$ to $Q_7$, adjacent groups may be bonded together to form a ring. In the formula (7), a represents an integer from 0 to 5, b represents an integer from 0 to 4, and k represents an integer 0 or 1.

(8)

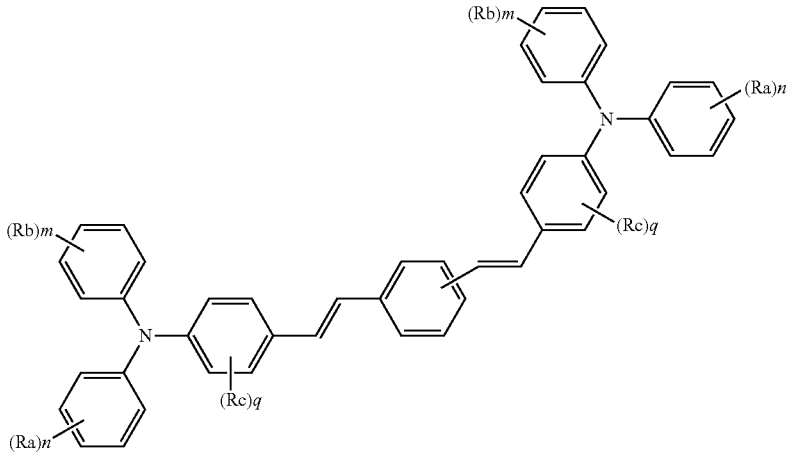

In Formula (8), Ra, Rb, and Rc each independently represent a hydrogen atom, an alkoxy group having 1 to 8 carbon atoms, a phenyl group, and an alkyl group having 1 to 8 carbon atoms. In the formula (8), q represents an integer from 0 to 4, and m and n each independently represents an integer from 0 to 5.

(9)

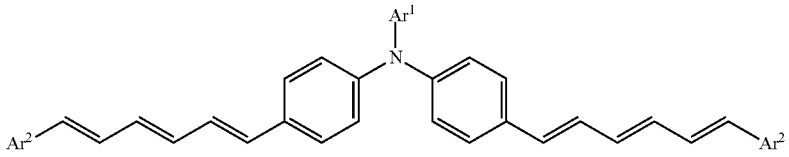

In the Formula (9), $Ar^1$ represents an aryl group or a heterocyclic group having conjugated double bonds. In the Formula (9), $Ar^2$ represents an aryl group. Note that $Ar^1$ and $Ar^2$ are each independently and optionally substituted with at least one group selected from among a phenoxy group, an alkyl group having 1 to 6 carbon atoms, and an alkoxy group having 1 to 6 carbon atoms.

Preferable examples of the compound represented by General Formula (6) include compounds represented by Formulae (CTM-1) to (CTM-4) below.

(CTM-1)

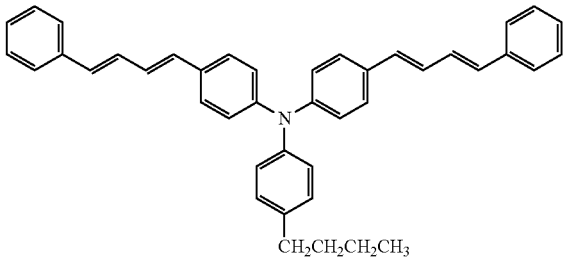

(CTM-2)

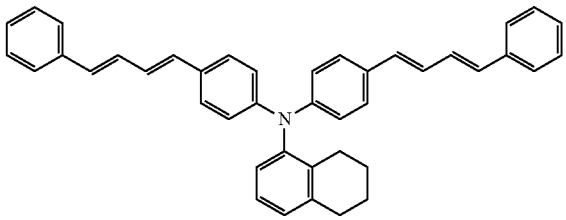

-continued (CTM-3)

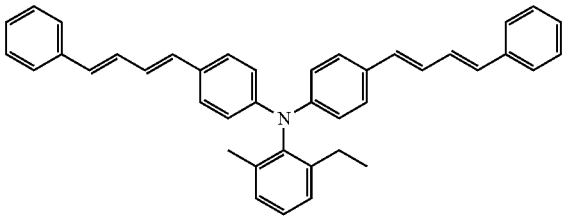

(CTM-4)

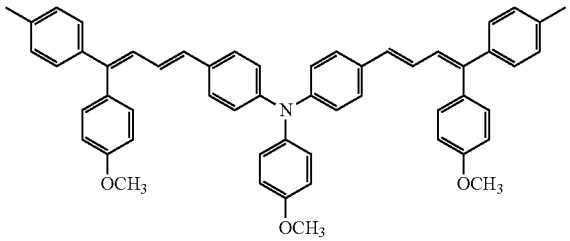

Preferable examples of the compound represented by General Formula (7) include compounds represented by Formulae (CTM-5) to (CTM-7) below.

(CTM-5)
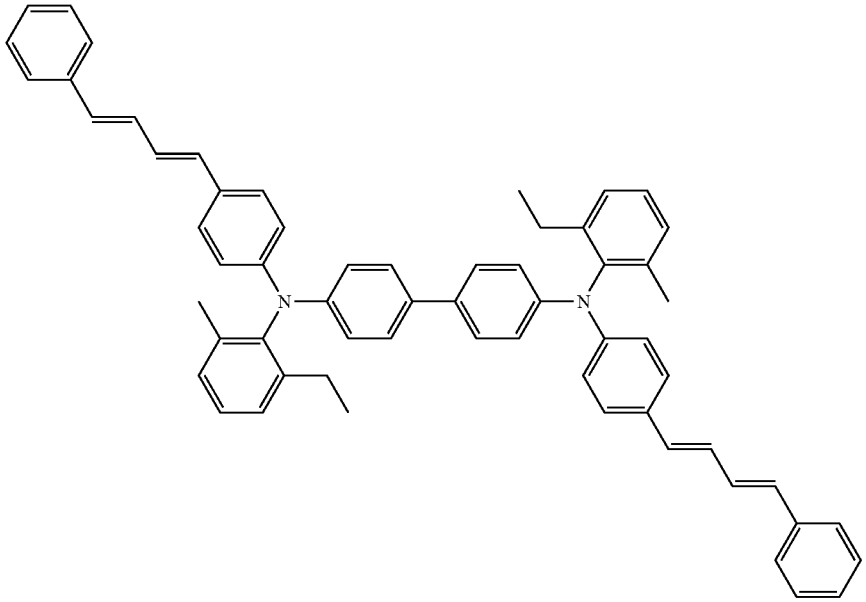
(CTM-6)
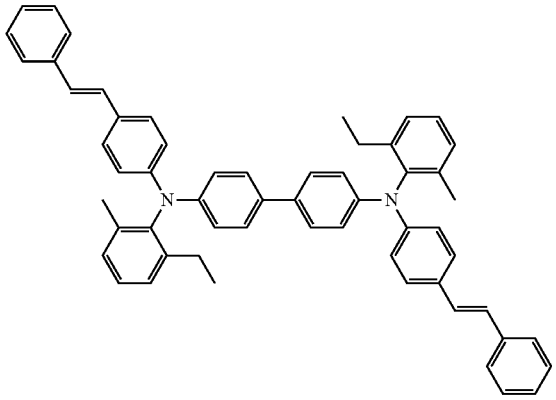
(CTM-7)
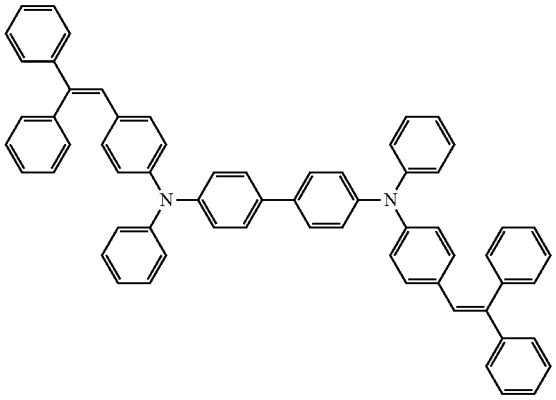
Preferable examples of the compound represented by General Formula (8) include compounds represented by Formulae (CTM-8) and (CTM-9) below.
(CTM-8)
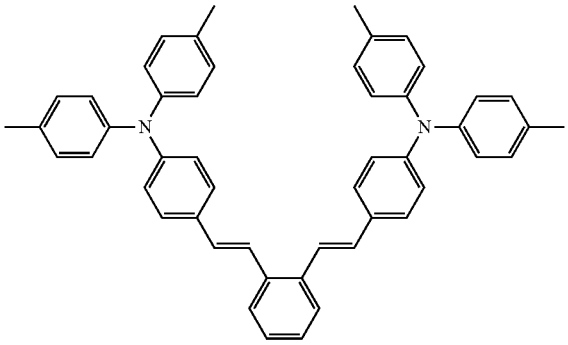
-continued
(CTM-9)
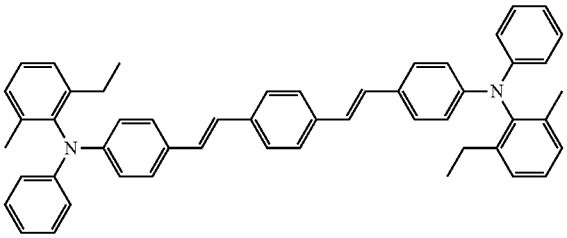
Preferable examples of the compound represented by General Formula (9) include a compound represented by Formula (CTM-10) below.

(CTM-10)

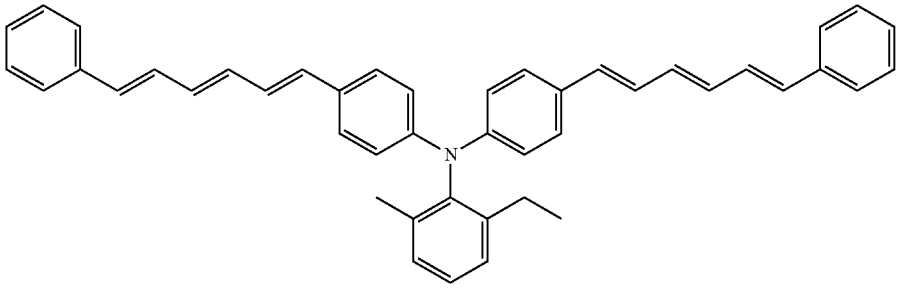

Preferable examples of the hole transport material also include compounds represented by Formulae (CTM-11) and (CTM-12) below.

(CTM-11)

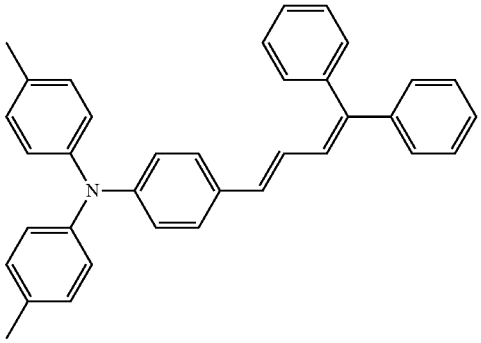

(CTM-12)

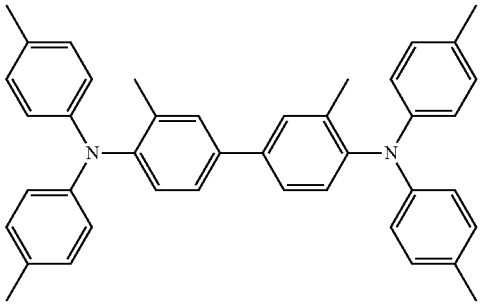

The charge transport layer may contain, in addition to the styryl-triarylamine derivative, a different hole transport material other than the styryl-triarylamine derivative. Preferable examples of the hole transport material include oxadiazole-based compounds (more specifically, 2,5-di(4-methylaminophenyl)-1,3,4-oxadiazole, and the like), styryl-based compounds (more specifically, 9-(4-diethylaminostyryl)anthracene, and the like), carbazole-based compounds (more specifically, polyvinyl carbazole, and the like), organic polysilane compounds, pyrazoline-based compound (more specifically, 1-phenyl-3-(p-dimethylaminophenyl)pyrazoline, and the like), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The hole transport materials listed above may be used singly or in combination of two or more.

(Electron Transport Material)

In the case where the charge transport layer or the single-layer photosensitive layer contain both a hole transport material and an electron transport material, the electron transport material is preferably at least one compound selected from among quinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride. Preferable examples of the electron transport material used in combination with a hole transport material include compounds represented by Formulae (ETM-6) to (ETM-11) below.

(ETM-6)

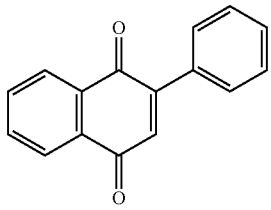

(ETM-7)

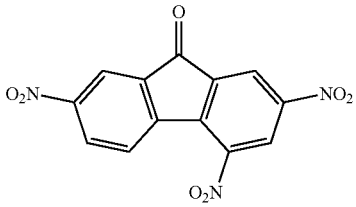

(ETM-8)

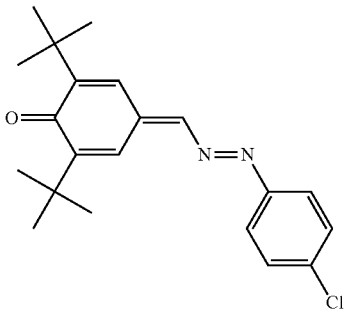

-continued (ETM-9)

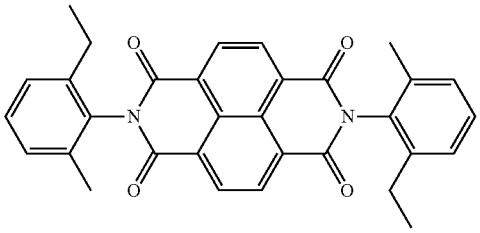

(ETM-10)

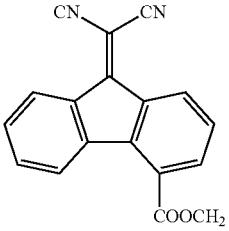

(ETM-11)

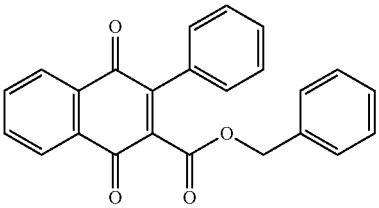

The amount of the electron transport material contained in the charge transport layer of the multi-layer photosensitive member is preferably at least 0.1 parts by mass and no greater than 20 parts by mass relative to 100 parts by mass of the binder resin, and more preferably at least 0.5 parts by mass and no greater than 5 parts by mass. The amount of the electron transport material contained in the single-layer photosensitive layer of the single-layer photosensitive member is preferably at least 5 parts by mass and no greater than 100 parts by mass relative to 100 parts by mass of the binder resin, and more preferably at least 10 parts by mass and no greater than 80 parts by mass.

[Resin]

The photosensitive layer included in the electrophotographic photosensitive member according to the present embodiment contains a resin for binding materials contained in the layer. In the example in which the electrophotographic photosensitive member according to the present embodiment is the multi-layer photosensitive member 10 shown in FIG. 1A, the charge generating layer 13 contains a base resin and the charge transport layer 14 contains a binder resin. In the example in which the electrophotographic photosensitive member according to the present embodiment is the single-layer photosensitive member 20 shown in FIG. 2A, the single-layer photosensitive layer 22 contains a binder resin. In the description of the present embodiment, the resin contained in the charge transport layer of the multi-layer photosensitive member or the photosensitive layer of the single-layer photosensitive member is referred to the "binder resin". In the case where the charge generating layer of the multi-layer photosensitive member contains a resin, the resin contained in the charge generating layer is referred to as the "base resin".

(Binder Resin)

The binder resin preferably contains a polycarbonate resin. Preferable examples of the polycarbonate resin contained in the binder resin include resins represented by Formulae (Resin-1) to (Resin-5). Note that the numerical subscripts appearing in Formulae (Resin-1), (Resin-2), and (Resin-5), such as "20", "40", "60", and "80", each represent the proportion (% by mole) of the repeating units in the polycarbonate resin. In addition, the subscript "n" appearing in Formulae (Resin-3) and (Resin-4) represents the number of the repeating units (degree of polymerization).

(Resin-1)

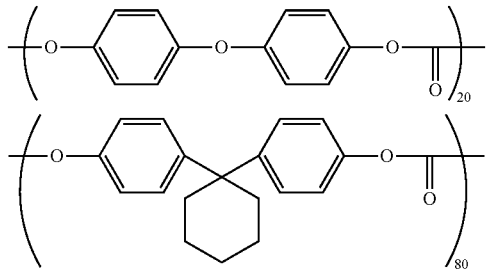

(Resin-2)

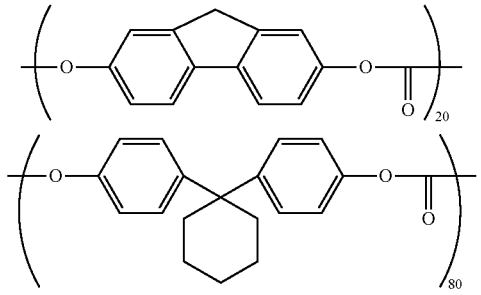

(Resin-3)

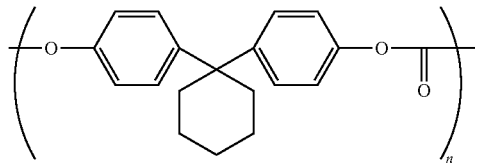

(Resin-4)

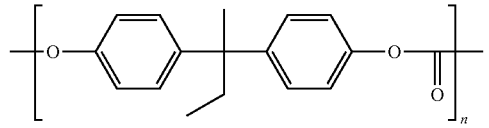

(Resin-5)

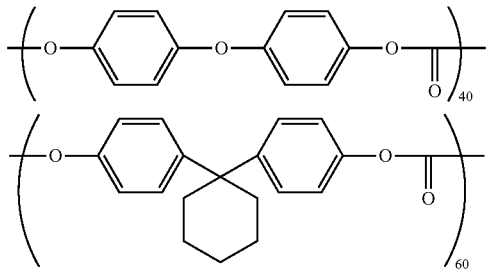

As the binder resin, a polycarbonate resin may be used singly or two or more resins (for example, two different resins: a polycarbonate resin and a resin other than the polycarbonate resin) may be used in combination. The amount of the polycarbonate resin contained in the binder resin is preferably at least 95% by mass, and more preferably 100% by mass.

For example, in addition to or instead of the polycarbonate resin, at least one of the thermoplastic resins, thermosetting resins, and photocurable resins listed below may be used as the binder resin. The thermoplastic resins selectable for the binder resin include styrene-based resins, styrene-butadiene copolymers, styrene-acrylonitrile copolymers, styrene-maleate copolymers, styrene-acrylate copolymers, acrylic acid-based copolymers, polyethylene copolymers, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, polyether resins, and polyester resins. The thermosetting resins selectable for the binder resin include silicone resins, epoxy resins, phenolic resins, urea resins, and melamine resins. The photocurable resins selectable for the binder resin include epoxy acrylate resins and urethane acrylate copolymers.

The viscosity average molecular weight of the binder resin is preferably at least 40,000, and more preferably at least 40,000 and no greater than 60,000, and particularly more preferably at least 40,000 and no greater than 52,500. When the binder resin has a viscosity average molecular weight of at least 40,000, the abrasion resistance of the binder resin tends to improve. This can contribute to suppress abrasion of the charge transport layer of the multi-layer photosensitive member or the single-layer photosensitive layer. When the binder resin has a viscosity average molecular weight of no greater than 60,000, the solubility of the binder resin tends to improve. This tends to facilitate preparation of an application liquid for forming a charge transport layer, with the use of a non-halogen based polar solvent or a nonpolar solvent.

(Base Resin)

Preferable examples of the base resin include styrene-butadiene copolymers, styrene-acrylonitrile copolymers, styrene-maleate copolymers, acrylic acid-based copolymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl acetal resins, polyvinyl butyral resins, polyether resins, silicone resins, epoxy resins, phenolic resins, urea resins, melamine resins, epoxy acrylate resins, and urethane-acrylate resins. Among the examples of the base resin listed above, the polyvinyl butyral resins are preferable. The base resins listed above may be used singly or in combination of two or more.

To form a charge generating layer and then form a charge transport layer on the charge generating layer, it is preferable to prepare an application liquid for forming the charge transport layer, by using a base resin different from the binder resin. This prevents the base resin from dissolving into the solvent of the application liquid.

[Additive]

The electrophotographic photosensitive member according to the present embodiment may contain an additive in at least one of the multi-layer photosensitive layer (the charge generating layer and the charge transport layer), the single-layer photosensitive layer, and the intermediate layer. Preferable examples of an additive that can be contained in the photosensitive layer or the intermediate layer include antidegradants (antioxidant, radical scavenger, singlet quencher, and ultraviolet absorbing agent), softeners, surface modifiers, bulking agents, thickeners, dispersion stabilizers, waxes, acceptors, donors, surfactants, and leveling agents. Preferable examples of an antioxidant that can be contained in the photosensitive layer or the intermediate layer include hindered phenol, hindered amine, paraphenylenediamine, arylalkane, hydroquinone, spirochromane, spiroindanone, and their derivatives, and also include organosulfur compounds and organophosphorous compounds. Preferable examples of an antioxidant that can be contained in the charge transport layer or the single-layer photosensitive layer include hindered phenol-based compounds, hindered amine-based compounds, thioether-based compounds, and phosphite-based compounds.

In order to improve the sensitivity of the charge generating layer or the single-layer photosensitive layer, the corresponding one of the charge generating layer and the single-layer photosensitive layer may contain a sensitizer (for example, terphenyl, halonaphthoquinones, or acenaphthylene).

In order to improve the oil crack resistance of the charge transport layer or the single-layer photosensitive layer, the corresponding one of the charge transport layer and the single-layer photosensitive layer may contain a plasticizer. Preferable examples of the plasticizer include a biphenyl derivative and a phenanthrene derivative. Preferable examples of the biphenyl derivative or the phenanthrene derivative include compounds represented by Formulae (BP-1) to (BP-20) below.

(BP-1)

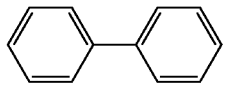

(BP-2)

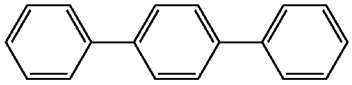

(BP-3)

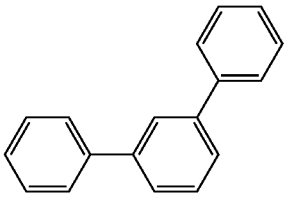

(BP-4)

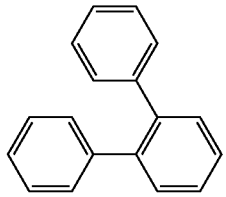

(BP-5)

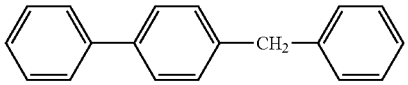

(BP-6)

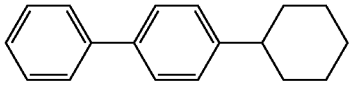

-continued (BP-7)

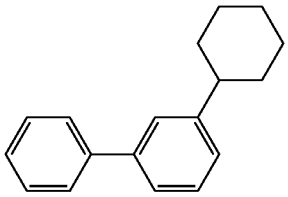

(BP-8)

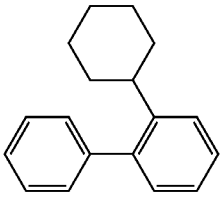

(BP-9)

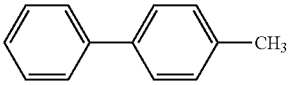

(BP-10)

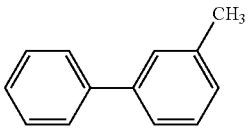

(BP-11)

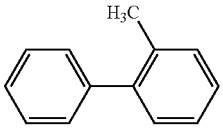

(BP-12)

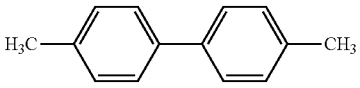

(BP-13)

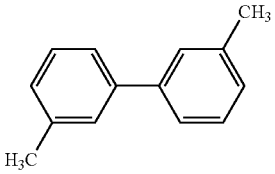

(BP-14)

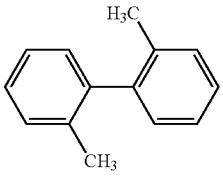

(BP-15)

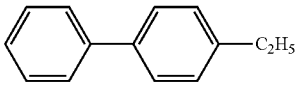

(BP-16)

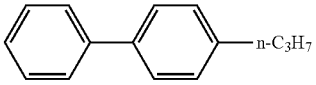

(BP-17)

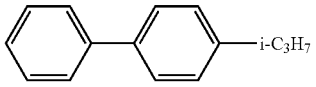

-continued (BP-18)

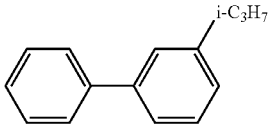

(BP-19)

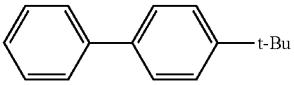

(BP-20)

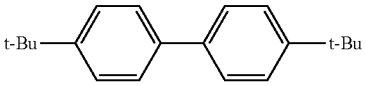

In addition, the charge transport layer or the single-layer photosensitive layer may contain a compound represented by any one of Formulae (ADD-9) to (ADD-11) below.

(ADD-9)

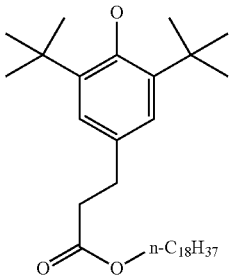

(ADD-10)

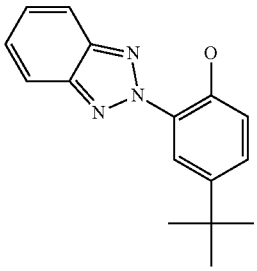

(ADD-11)

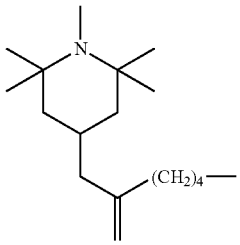

[Intermediate Layer]

The electrophotographic photosensitive member according to the present embodiment may include an intermediate layer (for example, an undercoat layer formed on the substrate). The intermediate layer preferably contains a resin and inorganic particles. The intermediate layer disposed between the substrate and the photosensitive layer can ensure smooth flow of an electric current generated upon exposure of the electrophotographic photosensitive member to light (and thus to restrict increase in the resistance), while maintaining an appropriate level of insulation for restricting leakage of the electric current.

Preferable examples of inorganic particles contained in the intermediate layer include particles of metal (for example, aluminum, iron, or copper), particles of metal oxide (for example, titanium oxide, alumina, zirconium oxide, tin oxide, or zinc oxide), and particles of non-metal oxide (for example, silica).

The presence of light-scattering particles in the intermediate layer can enable the intermediate layer to scatter incident light, restricting occurrence of interference stripes. During the time the photosensitive member is not exposed to light, the presence of light-scattering particles can restrict injection of charges from the substrate to the photosensitive layer, restricting occurrence of fogging and black spots. Examples of light-scattering particles include white pigments (more specifically, titanium oxide, zinc oxide, zinc sulfide, white lead, lithopone, and the like), extender pigments (more specifically, alumina, calcium carbonate, barium sulfate, and the like), fluororesin particles, benzoguanamine resin particles, and styrene resin particles. One type of particles may be used alone, or two or more types of the particles may be used in combination.

<Method of Manufacturing Electrophotographic Photosensitive Member>

The single-layer photosensitive member can be manufactured by applying an application liquid for forming a single-layer photosensitive layer (hereinafter, referred to as a first application liquid) over a substrate, followed by drying. The first application liquid is prepared by dissolving or dispersing a charge generating material, a charge transport material, a binder resin, and silica particles in a liquid (for example, solvent). The first application liquid may additionally contain one or more additives as necessary. For example, the first application liquid may contain a surfactant or a leveling agent for improving the dispersibility of the respective components or to improve the surface smoothness of the layer to be formed.

One example of a method of manufacturing a multi-layer photosensitive member involves forming a charge generating layer and a charge transport layer on the substrate in the following manner.

First, an application liquid for forming a charge generating layer (hereinafter, referred to as a second application liquid) and an application liquid for forming a charge transport layer (hereinafter, referred to as a third application liquid) are prepared. The second application liquid is prepared by dissolving or dispersing a charge generating material and a base resin in a liquid (for example, solvent). The third application liquid is prepared by dissolving or dispersing a charge transport material, a binder resin, and silica particles in a liquid (for example, solvent). Each application liquid may contain one or more additive (for example, surfactant or leveling agent) as necessary.

Subsequently, the second application liquid is applied onto the substrate, followed by drying. As a result, the charge generating layer is formed on the substrate. Next, the third application liquid is applied onto the charge generating layer, followed by drying. As a result, the charge transport layer is formed on the charge generating layer.

Preferable examples of the liquids (for example, solvents) usable for preparing the respective application liquids (the first to third application liquids) include alcohols (more specifically, methanol, ethanol, isopropanol, butanol, and the like), aliphatic hydrocarbons (more specifically, n-hexane, octane, cyclohexane, and the like), aromatic hydrocarbons (more specifically, benzene, toluene, xylene, and the like), halogenated hydrocarbons (more specifically, dichloromethane, dichloroethane, carbon tetrachloride, chlorobenzene, and the like), ethers (more specifically, dimethyl ether, diethyl ether, tetrahydrofuran, ethylene glycol dimethyl ether, diethylene glycol dimethyl ether, and the like), ketones (more specifically, acetone, methyl ethyl ketone, cyclohexanone, and the like), esters (more specifically, ethyl acetate, methyl acetate, and the like), dimethyl formaldehyde, dimethyl formamide, and dimethyl sulfoxide. The solvents listed above may be used singly or in combination of two or more. In order to improve the workability in manufacture of the photosensitive member, a non-halogenated solvent is preferable as the solvent.

Each of the application liquids (each of the first to third application liquids) is prepared by mixing the components of the application liquid and then dissolving or dispersing the resultant mixture in a liquid (for example, a solvent). The mixing or dispersing can be carried out by using, for example, a bead mill, a roll mill, a ball mill, an attritor, a paint shaker, or an ultrasound disperser.

A preferable method of applying each of the application liquids (each of the first to third application liquids) is one that ensures a uniform application of the application liquid. Examples of the preferable application method include dip coating, spray coating, spin coating, roller coating, bead coating, blade coating, and bar coating.

A preferable method of drying each of the application liquids (each of the first to third application liquids) is one that ensures appropriate evaporation of the solvent contained in the application liquid. Examples of the preferable drying method include a heat treatment (hot-air drying) with a high-temperature dryer or a reduced pressure dryer. Preferable conditions for the heat treatment are: the processing temperature of at least 40° C. and no greater than 150° C.; and the processing time of at least 3 minutes and no greater than 120 minutes.

The electrophotographic photosensitive members according to the present embodiment described above are each appropriately applicable to various types of image forming apparatuses. Each substituent in the compounds represented by the general formulae described above (when a plurality of substituents are included in one compound, the substituents may be of the same or different species) can be appropriately selected, depending on the usage or the like of the electrophotographic photosensitive member, from among: a halogen atom (more specifically, a fluoro group, a chloro group, a bromo group, an iodine group, or the like), a nitro group, a cyano group, an amino group, a hydroxyl group, a carboxyl group, a sulfanyl group, a carbamoyl group, a linear or branched alkyl group having 1 to 12 carbon atoms, a cycloalkyl group having 3 to 12 carbon atoms, an alkoxy group having 1 to 12 carbon atoms, an alkyl sulfanyl group having 1 to 12 carbon atoms, an alkyl sulfonyl group having 1 to 12 carbon atoms, an alkanoyl group having 2 to 13 carbon atoms, an alkoxycarbonyl group having 2 to 13 carbon atoms, an aryl group having 6 to 14 carbon atoms (more specifically, a monocyclic ring or a bicyclic or tricyclic fused ring), and 6- to 14-membered heterocyclic group (more specifically, a monocyclic ring or a bicyclic or tricyclic fused ring).

Examples

The following explains Examples of the present disclosure. Note, however, that the present disclosure is not limited to Examples. In the following explanation, the compounds represented by the respective formulae may be denoted simply by the numerals of the corresponding formulae. For example, the compound represented by Formula (CTM-1) may be denoted simply by "CTM-1".

Evaluation 1

The following explains Evaluation 1. Table 1 shows photosensitive members A-1 to A-32 and B-1 to B-3 (each of which is an electrophotographic photosensitive member) subjected to Evaluation 1.

TABLE 1

| | Charge Transport Layer | | | | | | |
|---|---|---|---|---|---|---|---|
| | Binder | | | | Silica Particles | | |
| Photo-sensitive Member | Resin (Molecular Weight) | Hole Transport Material | Electron Transport Material | Pigment | Type (Particle Diameter) | Surface Treatment | Amount |
| A-1 | Resin-1 | CTM-1 | ETM-1 | x-$H_2$Pc | RX200 | HMDS | 5.0 |
| A-2 | (51,000) | CTM-2 | | | (12 nm) | | |
| A-3 | | CTM-3 | | | | | |
| A-4 | | CTM-4 | | | | | |
| A-5 | | CTM-5 | | | | | |
| A-6 | | CTM-6 | | | | | |
| A-7 | | CTM-7 | | | | | |
| A-8 | | CTM-8 | | | | | |
| A-9 | | CTM-9 | | | | | |
| A-10 | | CTM-10 | | | | | |
| A-11 | | CTM-11 | | | | | |
| A-12 | | CTM-12 | | | | | |
| A-13 | Resin-1 | CTM-1 | ETM-2 | x-$H_2$Pc | RX200 | HMDS | 5.0 |
| A-14 | (51,000) | | ETM-3 | | (12 nm) | | |
| A-15 | | | ETM-4 | | | | |
| A-16 | | | ETM-5 | | | | |
| A-17 | Resin-1 | CTM-1 | ETM-1 | Y-TiOPc | RX200 | HMDS | 5.0 |
| A-18 | (51,000) | | | α-TiOPc | (12 nm) | | |
| A-19 | | | | ϵ-CuPc | | | |
| A-20 | | | | None | | | |
| A-21 | Resin-2 | CTM-1 | ETM-1 | x-$H_2$Pc | RX200 | HMDS | 5.0 |
| | (50,500) | | | | (12 nm) | | |
| A-22 | Resin-3 | | | | | | |
| | (50,000) | | | | | | |
| A-23 | Resin-1 | | | | | | |
| | (40,000) | | | | | | |
| A-24 | Resin-1 | | | | | | |
| | (32,500) | | | | | | |
| A-25 | Resin-1 | CTM-1 | ETM-1 | x-$H_2$Pc | RX300 | HMDS | 5.0 |
| | (51,000) | | | | (7 nm) | | |
| A-26 | | | | | NAX50 | HMDS | 5.0 |
| | | | | | (50 nm) | | |
| A-27 | | | | | R974 | DMDCS | 5.0 |
| | | | | | (12 nm) | | |
| A-28 | | | | | RY200 | PDMS | 5.0 |
| | | | | | (12 nm) | | |
| A-29 | Resin-1 | CTM-1 | ETM-1 | x-$H_2$Pc | RX200 | HMDS | 10.0 |
| A-30 | (51,000) | | | | (12 nm) | | 15.0 |
| A-31 | | | | | | | 2.0 |
| A-32 | | | | | | | 0.5 |
| B-1 | | | | | | None | |
| B-2 | | | None | | | None | |
| B-3 | | | None | None | | None | |

[Method of Manufacturing Photosensitive Member A-1]

(Formation of Intermediate Layer)

First, surface-treated particles of titanium oxide (SMT-A, test product of TAYCA CORPORATION, number average primary particle diameter: 10 nm) were prepared. More specifically, particles of titanium oxide were surface treated with alumina and silica, and then the surface treated particles of titanium oxide were further surface treated with methyl hydrogen polysiloxane during wet dispersion by a bead mill. As a result, titanium oxide particles for forming an intermediate layer were obtained.

Subsequently, to a solvent containing 10 parts by mass of methanol, 1 part by mass of butanol, and 1 part by mass of toluene, the following were added: 2 parts by mass of the titanium oxide particles prepared through the process described above and 1 part by mass of a four-component copolymer polyamide resin of polyamide 6, polyamide 12, polyamide 66, and polyamide 610 (Nylon resin Amilan (registered Japanese trademark) CM8000, product of Toray Industries, Inc.). Subsequently, the materials put into the solvent were mixed for five hours by using a bead mill, causing the materials to be dispersed in the solvent. Through the above process, an application liquid for forming an intermediate layer was obtained.

Subsequently, the application liquid thus obtained was filtered using a 5 μm filter. The application liquid resulting from the filtration was applied by dip coating onto an aluminum support having the shape of a drum (diameter: 30 mm, and length: 246 mm) Subsequently, the application liquid thus applied was dried at 130° C. for 30 minutes. Through the above process, an intermediate layer was formed to a thickness of 1 μm on the substrate (the support having the shape of a drum).

(Formation of Charge Generating Layer)

To a solvent containing 40 parts by mass of propylene glycol monomethyl ether and 40 parts by mass of tetrahydrofuran, the following were added: 1.5 parts by mass of titanyl phthalocyanine (Y—TiOPc) and 1 part by mass of a polyvinyl acetal resin (S-LEC BX-5, product of Sekisui Chemical Co., Ltd.) as a base resin. The titanyl phthalocyanine (Y—TiOPc) added here exhibits a major peak at the Bragg angle 2θ±0.2°=27.2° with respect to characteristic X-rays of CuKα. Subsequently, the materials added to the solvent were mixed for two hours by using a bead mill, causing the materials to be dispersed in the solvent. Through the above process, an application liquid for forming a charge generating layer was obtained.

Subsequently, the application liquid thus obtained was filtered using a 3 μm filter. The application liquid resulting from the filtration was applied by dip coating onto the intermediate layer formed through the above process. Subsequently, the application liquid thus applied was dried at 50° C. for 5 minutes. Through the above process, a charge generating layer was formed to a thickness of 0.3 μm on the intermediate layer.

(Formation of Charge Transport Layer)

To a solvent containing 350 parts by mass of tetrahydrofuran and 350 parts by mass of toluene, the following were added: 50 parts by mass of the hole transport material (CTM-1), 2 parts by mass of the electron transport material (ETM-1), 100 parts by mass of the binder resin (Resin-1, viscosity average molecular weight: 51,000), 5 parts by mass of silica particulates surface treated with hexamethyldisilazane (HMDS) (Aerosil (registered Japanese trademark) RX200, product of Nippon Aerosil Co., Ltd., number average primary particle diameter: 12 nm), 0.4 parts by mass of an X-type metal-free phthalocyanine (x-$H_2$PC) pigment (FASTOGEN Blue 8120BS, product of DIC Cooperation), and 2 parts by mass of hindered phenol-based antioxidant (Irganox (registered Japanese trademark) 1010, product of BASF). Subsequently, the materials added to the solvent were mixed for 12 hours by using a circulating ultrasound disperser, dispersing the materials in the solvent. Through the above process, an application liquid for forming a charge transport layer was obtained.

Subsequently, the application liquid thus obtained was filtered using a 3 μm filter. The application liquid resulting from the filtration was applied by dip coating onto the charge generating layer formed through the above process. Subsequently, the application liquid thus applied was dried at 120° C. for 40 minutes. Through the above process, a charge transport layer was formed to a thickness of 30 μm on the charge generating layer. This completed the manufacture of a photosensitive member A-1 (multi-layer photosensitive member) having the intermediate layer, the charge generating layer, and the charge transport layer stacked on the substrate in the order stated.

[Method of Manufacturing Photosensitive Member A-2]

A photosensitive member A-2 (multi-layer photosensitive member) was manufactured in the same manner as the photosensitive member A-1 except that the hole transport material used was CTM-2 instead of CTM-1.

[Method of Manufacturing Photosensitive Member A-3]

A photosensitive member A-3 (multi-layer photosensitive member) was manufactured in the same manner as the photosensitive member A-1 except that the hole transport material used was CTM-3 instead of CTM-1.

[Method of Manufacturing Photosensitive Member A-4]

A photosensitive member A-4 (multi-layer photosensitive member) was manufactured in the same manner as the photosensitive member A-1 except that the hole transport material used was CTM-4 instead of CTM-1.

[Method of Manufacturing Photosensitive Member A-5]

A photosensitive member A-5 (multi-layer photosensitive member) was manufactured in the same manner as the photosensitive member A-1 except that the hole transport material used was CTM-5 instead of CTM-1.

[Method of Manufacturing Photosensitive Member A-6]

A photosensitive member A-6 (multi-layer photosensitive member) was manufactured in the same manner as the photosensitive member A-1 except that the hole transport material used was CTM-6 instead of CTM-1.

[Method of Manufacturing Photosensitive Member A-7]

A photosensitive member A-7 (multi-layer photosensitive member) was manufactured in the same manner as the photosensitive member A-1 except that the hole transport material used was CTM-7 instead of CTM-1.

[Method of Manufacturing Photosensitive Member A-8]

A photosensitive member A-8 (multi-layer photosensitive member) was manufactured in the same manner as the photosensitive member A-1 except that the hole transport material used was CTM-8 instead of CTM-1.

[Method of Manufacturing Photosensitive Member A-9]

A photosensitive member A-9 (multi-layer photosensitive member) was manufactured in the same manner as the photosensitive member A-1 except that the hole transport material used was CTM-9 instead of CTM-1.

[Method of Manufacturing Photosensitive Member A-10]

A photosensitive member A-10 (multi-layer photosensitive member) was manufactured in the same manner as the photosensitive member A-1 except that the hole transport material used was CTM-10 instead of CTM-1.

[Method of Manufacturing Photosensitive Member A-11]

A photosensitive member A-11 (multi-layer photosensitive member) was manufactured in the same manner as the photosensitive member A-1 except that the hole transport material used was CTM-11 instead of CTM-1.

[Method of Manufacturing Photosensitive Member A-12]

A photosensitive member A-12 (multi-layer photosensitive member) was manufactured in the same manner as the photosensitive member A-1 except that the hole transport material used was CTM-12 instead of CTM-1.

[Method of Manufacturing Photosensitive Member A-13]

A photosensitive member A-13 (multi-layer photosensitive member) was manufactured in the same manner as the photosensitive member A-1 except that the electron transport material used was ETM-2 instead of ETM-1.

[Method of Manufacturing Photosensitive Member A-14]

A photosensitive member A-14 (multi-layer photosensitive member) was manufactured in the same manner as the photosensitive member A-1 except that the electron transport material used was ETM-3 instead of ETM-1.

[Method of Manufacturing Photosensitive Member A-15]

A photosensitive member A-15 (multi-layer photosensitive member) was manufactured in the same manner as the photosensitive member A-1 except that the electron transport material used was ETM-4 instead of ETM-4.

[Method of Manufacturing Photosensitive Member A-16]

A photosensitive member A-16 (multi-layer photosensitive member) was manufactured in the same manner as the photosensitive member A-1 except that the electron transport material used was ETM-5 instead of ETM-1.

[Method of Manufacturing Photosensitive Member A-17]

A photosensitive member A-17 (multi-layer photosensitive member) was manufactured in the same manner as the photosensitive member A-1 except that the pigment added to the charge transport layer was a Y-type titanyl phthalocyanine (Y—TiOPc) pigment instead of the X-type metal-free phthalocyanine pigment.

[Method of Manufacturing Photosensitive Member A-18]

A photosensitive member A-18 (multi-layer photosensitive member) was manufactured in the same manner as the photosensitive member A-1 except that the pigment added to the charge transport layer was an α-type titanyl (α-TiOPc) phthalocyanine pigment instead of the X-type metal-free phthalocyanine pigment.

[Method of Manufacturing Photosensitive Member A-19]

A photosensitive member A-19 (multi-layer photosensitive member) was manufactured in the same manner as the photosensitive member A-1 except that the pigment added to the charge transport layer was an ϵ-type copper phthalocyanine (ϵ-CuPc) pigment instead of the X-type metal-free phthalocyanine pigment.

[Method of Manufacturing Photosensitive Member A-20]

A photosensitive member A-20 (multi-layer photosensitive member) was manufactured in the same manner as the photosensitive member A-1 except that no pigment was added to the charge transport layer.

[Method of Manufacturing Photosensitive Member A-21]

A photosensitive member A-21 (multi-layer photosensitive member) was manufactured in the same manner as the photosensitive member A-1 except that the binder resin used was Resin-2 (viscosity average molecular weight: 50,500) instead of Resin-1 (viscosity average molecular weight: 51,000).

[Method of Manufacturing Photosensitive Member A-22]

A photosensitive member A-22 (multi-layer photosensitive member) was manufactured in the same manner as the photosensitive member A-1 except that the binder resin used was Resin-3 (viscosity average molecular weight: 50,000) instead of Resin-1 (viscosity average molecular weight: 51,000).

[Method of Manufacturing Photosensitive Member A-23]

A photosensitive member A-23 (multi-layer photosensitive member) was manufactured in the same manner as the photosensitive member A-1 except that the binder resin used was Resin-1 (viscosity average molecular weight: 40,000) instead of Resin-1 (viscosity average molecular weight: 51,000).

[Method of Manufacturing Photosensitive Member A-24]

A photosensitive member A-24 (multi-layer photosensitive member) was manufactured in the same manner as the photosensitive member A-1 except that the binder resin used was Resin-1 (viscosity average molecular weight: 32,500) instead of Resin-1 (viscosity average molecular weight: 51,000).

[Method of Manufacturing Photosensitive Member A-25]

A photosensitive member A-25 (multi-layer photosensitive member) was manufactured in the same manner as the photosensitive member A-1 except that silica particulates (Aerosil RX300, product of Nippon Aerosil Co., Ltd., number average primary particle diameter: 7 nm) were used instead of the silica particulates (Aerosil RX200, product of Nippon Aerosil Co., Ltd., number average primary particle diameter: 12 nm).

[Method of Manufacturing Photosensitive Member A-26]

A photosensitive member A-26 (multi-layer photosensitive member) was manufactured in the same manner as the photosensitive member A-1 except that silica particulates surface treated with hexamethyldisilazane (HMDS) (Aerosil NAX50, product of Nippon Aerosil Co., Ltd., number average primary particle diameter: 50 nm) were used instead of the silica particulates (Aerosil RX200, product of Nippon Aerosil Co., Ltd., number average primary particle diameter: 12 nm).

[Method of Manufacturing Photosensitive Member A-27]

A photosensitive member A-27 (multi-layer photosensitive member) was manufactured in the same manner as the photosensitive member A-1 except that silica particulates surface treated with dimethyldichlorosilane (DMDCS) (Aerosil R974, product of Nippon Aerosil Co., Ltd., number average primary particle diameter: 12 nm) were used instead of the silica particulates (Aerosil RX200, product of Nippon Aerosil Co., Ltd., number average primary particle diameter: 12 nm).

[Method of Manufacturing Photosensitive Member A-28]

A photosensitive member A-28 (multi-layer photosensitive member) was manufactured in the same manner as the photosensitive member A-1 except that silica particulates surface treated with polydimethylsiloxane (PDMS) (Aerosil RY200, product of Nippon Aerosil Co., Ltd., number average primary particle diameter: 12 nm) were used instead of the silica particulates (Aerosil RX200, product of Nippon Aerosil Co., Ltd., number average primary particle diameter: 12 nm).

[Method of Manufacturing Photosensitive Member A-29]

A photosensitive member A-29 (multi-layer photosensitive member) was manufactured in the same manner as the photosensitive member A-1 except that the additive amount of the silica particulates was 10 parts by mass instead of 5 parts by mass.

[Method of Manufacturing Photosensitive Member A-30]

A photosensitive member A-30 (multi-layer photosensitive member) was manufactured in the same manner as the photosensitive member A-1 except that the additive amount of the silica particulates was 15 parts by mass instead of 5 parts by mass.

[Method of Manufacturing Photosensitive Member A-31]

A photosensitive member A-31 (multi-layer photosensitive member) was manufactured in the same manner as the photosensitive member A-1 except that the additive amount of the silica particulates was 2 parts by mass instead of 5 parts by mass.

[Method of Manufacturing Photosensitive Member A-32]

A photosensitive member A-32 (multi-layer photosensitive member) was manufactured in the same manner as the photosensitive member A-1 except that the additive amount of the silica particulates was 0.5 parts by mass instead of 5 parts by mass.

[Method of Manufacturing Photosensitive Member B-1]

A photosensitive member B-1 (multi-layer photosensitive member) was manufactured in the same manner as the photosensitive member A-1 except that no silica particles was added to the charge transport layer.

[Method of Manufacturing Photosensitive Member B-2]

A photosensitive member B-2 (multi-layer photosensitive member) was manufactured in the same manner as the photosensitive member A-1 except that neither silica particles nor an electron transport material was added to the charge transport layer.

[Method of Manufacturing Photosensitive Member B-3]

A photosensitive member B-3 (multi-layer photosensitive member) was manufactured in the same manner as the photosensitive member A-1 except that none of silica particles, electron transport material, and pigment was added to the charge transport layer.

[Evaluation Method]

The respective samples (the photosensitive members A-1 to B-3) were evaluated.

(Electrical Characteristics Evaluation)

Each sample (photosensitive member) was charged by a drum sensitivity test device manufactured by GEN-TECH, INC. at an initial charging of −800 V and a rotational speed of 31 rpm. Subsequently, the surface of the sample was irradiated with monochromatic light (wavelength: 780 nm, light quantity: 1.0 μJ/cm$^2$) extracted from light of a halogen lamp through a bandpass filter. Upon passage of 50 msec from the irradiation with monochromatic light, the surface potential (residual potential $V_L$) of the sample was measured. The measurement was carried out in an environment with a temperature of 10° C. and a humidity of 15% RH.

(Abrasion Resistance Evaluation)

Each of the sample (photosensitive member) prepared in the above manner was evaluated for its abrasion resistance by evaluating an application liquid for forming a corresponding charge transport layer (in the explanation of the abrasion resistance evaluation, the application liquid is simply referred to as an "evaluation application liquid"). More specifically, the evaluation application liquid was applied onto a 0.3 mm-thick polypropylene sheet wound around an aluminum pipe measuring 78 mm in diameter, followed by drying at 120° C. for 40 minutes. As a result, an evaluation sheet was formed to a thickness of 30 μm on the polypropylene sheet.

Subsequently, the evaluation sheet was removed from the polypropylene sheet. The evaluation sheet thus removed was attached to a specimen mounting card (S-36, product of TABER Industries) to prepare a specimen.

Subsequently, the mass $M_A$ of the specimen before the abrasion test was measured. Then, the abrasion test was performed on the sample. More specifically, the specimen was set on a rotary table of a rotary ablation tester (Toyo Seiki Seisaku-sho, Ltd.). The rotary table was rotated for 1,000 times at a rotational speed of 60 rpm, with an abrasion wheel (CS-10, product of TABER Industries) placed on the sample to apply a load of 500 gf.

Subsequently, the mass $M_B$ of the specimen after the abrasion test was measured. Then, the abrasion loss ($=M_A-M_B$) was measured as a difference between the mass of the sample before and after the abrasion test. Abrasion resistance was evaluated based on the abrasion loss which was measured. The measurement was carried out in an environment with a temperature of 23° C. and a humidity of 50% RH.

(Oil Crack Resistance)

After oil (oleic triglyceride) was attached to the surface of the sample (photosensitive member) (more specifically, 10 measurement locations on the surface), the sample was left to stand for 2 days at a temperature of 23° C. and a humidity of 50% RH. Then, the surface of the sample was observed under an optical microscope to check for cracking at each measurement location. The oil crack resistance was evaluated in accordance with the following criteria.

Very Good: Cracking was observed at 0 locations.

Good: Cracking was observed at 1 to 3 locations.

Acceptable: Cracking was observed at 4 to 10 locations.

Poor: Cracking was observed at 11 locations or more.

[Evaluation Results]

Table 2 shows the evaluation results (electrical characteristics (sensitivity), abrasion resistance, and oil crack resistance) of the respective samples (photosensitive members A-1 to B-3)

TABLE 2

| Photosensitive Member | Electrical Characteristics [V] | Abrasion Loss [mg] | Oil Crack Resistance |
|---|---|---|---|
| A-1 | 104 | 5.8 | Very Good |
| A-2 | 103 | 4.9 | Very Good |
| A-3 | 98 | 4.9 | Good |
| A-4 | 105 | 4.9 | Good |
| A-5 | 83 | 4.4 | Good |
| A-6 | 101 | 4.4 | Good |
| A-7 | 100 | 4.7 | Good |
| A-8 | 114 | 5.2 | Very Good |
| A-9 | 96 | 5.3 | Good |
| A-10 | 80 | 4.6 | Very Good |
| A-11 | 145 | 4.8 | Very Good |
| A-12 | 123 | 5.0 | Acceptable |
| A-13 | 99 | 5.0 | Very Good |
| A-14 | 96 | 5.9 | Very Good |
| A-15 | 105 | 5.4 | Good |
| A-16 | 109 | 4.7 | Good |
| A-17 | 105 | 4.4 | Very Good |
| A-18 | 98 | 5.5 | Very Good |
| A-19 | 101 | 5.2 | Very Good |
| A-20 | 102 | 5.1 | Acceptable |
| A-21 | 105 | 5.4 | Very Good |
| A-22 | 101 | 3.9 | Very Good |
| A-23 | 101 | 5.7 | Good |
| A-24 | 101 | 6.5 | Acceptable |
| A-25 | 105 | 5.5 | Very Good |
| A-26 | 98 | 5.1 | Good |
| A-27 | 104 | 5.4 | Acceptable |
| A-28 | 99 | 5.5 | Acceptable |
| A-29 | 100 | 5.2 | Very Good |
| A-30 | 103 | 5.4 | Good |
| A-31 | 99 | 5.4 | Very Good |
| A-32 | 101 | 5.7 | Very Good |
| B-1 | 125 | 7.8 | Very Good |
| B-2 | 120 | 7.7 | Very Good |
| B-3 | 130 | 7.5 | Acceptable |

As shown in Table 2, the photosensitive members A-1 to A-32 (the photosensitive members according to Examples of the present disclosure) each exhibited that the residual potential was no greater than 145 V, the abrasion loss was no greater than 7.0 mg, and cracking was observed at no greater than 10 locations (more specifically, no greater than 7 locations).

Evaluation 2

The following explains Evaluation 2. Table 3 shows photosensitive members C-1 to C-31 and D-1 to D-2 (each of which is an electrophotographic photosensitive member) subjected to Evaluation 2.

TABLE 3

| | Charge Transport Layer | | | | | | | |
|---|---|---|---|---|---|---|---|---|
| Photosensitive Member | Binder Resin (Molecular Weight) | Hole Transport Material | | Additive | | Silica Particles | | |
| | | Type | Amount | Type | Amount | Type | Surface Treatment | Amount |
| C-1 | Resin-3 | CTM-1 | 42 | ADD-1 | 5 | RX200 | HMDS | 5.0 |
| C-2 | (51,000) | CTM-2 | | | | (12 nm) | | |
| C-3 | | CTM-3 | | | | | | |
| C-4 | | CTM-4 | | | | | | |

TABLE 3-continued

| Photo-sensitive Member | Charge Transport Layer: Binder Resin (Molecular Weight) | Hole Transport Material: Type | Amount | Additive: Type | Amount | Silica Particles: Type | Surface Treatment | Amount |
|---|---|---|---|---|---|---|---|---|
| C-5 | | CTM-5 | | | | | | |
| C-6 | | CTM-6 | | | | | | |
| C-7 | | CTM-7 | | | | | | |
| C-8 | | CTM-8 | | | | | | |
| C-9 | | CTM-9 | | | | | | |
| C-10 | | CTM-10 | | | | | | |
| C-11 | | CTM-11 | | | | | | |
| C-12 | | CTM-12 | | | | | | |
| C-13 | Resin-3 | CTM-1 | 42 | ADD-2 | 5 | RX200 | HMDS | 5.0 |
| C-14 | (51,000) | | | ADD-3 | | (12 nm) | | |
| C-15 | | | | ADD-4 | | | | |
| C-16 | | | | ADD-5 | | | | |
| C-17 | | | | ADD-6 | | | | |
| C-18 | | | | ADD-7 | | | | |
| C-19 | | | | ADD-8 | | | | |
| C-20 | Resin-4 (50,500) | | | ADD-1 | | | | |
| C-21 | Resin-5 (50,000) | | | | | | | |
| C-22 | Resin-3 (40,000) | | | | | | | |
| C-23 | Resin-3 (32,500) | | | | | | | |
| C-24 | Resin-3 (51,000) | | | | | RX300 (7 nm) | | |
| C-25 | Resin-3 (51,000) | | | | | NAX50 (50 nm) | | |
| C-26 | Resin-3 (51,000) | CTM-1 | 50 | ADD-1 | 5 | R974 (12 nm) | DMDCS | 5.0 |
| C-27 | | | | | | RY200 (12 nm) | PDMS | 5.0 |
| C-28 | Resin-3 | CTM-1 | 42 | ADD-1 | 5 | RX200 | HMDS | 0.5 |
| C-29 | (51,000) | | | ADD-1 | 5 | (12 nm) | | 2.0 |
| C-30 | | | | ADD-1 | 5 | | | 10.0 |
| C-31 | | | | ADD-1 | 5 | | | 15.0 |
| D-1 | | | | — | — | — | — | — |
| D-2 | | | | ADD-1 | 5 | — | — | — |

[Method of Manufacturing Photosensitive Member C-1]

(Formation of Intermediate Layer)

First, surface-treated particles of titanium oxide (SMT-A, test product of TAYCA CORPORATION, number average primary particle diameter: 10 nm) were prepared. More specifically, particles of titanium oxide were surface treated with alumina and silica, and then the surface-treated particles of titanium oxide were further surface treated with methyl hydrogen polysiloxane during wet dispersion by a bead mill. As a result, particles of titanium oxide used for forming an intermediate layer were obtained.

Subsequently, to a solvent containing 10 parts by mass of methanol, 1 part by mass of butanol, and 1 part by mass of toluene, the following were added: 2 parts by mass of the titanium oxide particles prepared through the process described above and 1 part by mass of a four-component copolymer polyamide resin of polyamide 6, polyamide 12, polyamide 66, and polyamide 610 (Nylon resin Amilan CM8000, product of Toray Industries, Inc.). Subsequently, the materials added to the solvent were mixed for five hours by using a bead mill, causing the materials to be dispersed in the solvent. Through the above process, an application liquid for forming an intermediate layer was obtained.

Subsequently, the application liquid thus obtained was filtered using a 5 μm filter. The application liquid resulting from the filtration was applied by dip coating onto an aluminum support having the shape of a drum (diameter: 30 mm, and length: 246 mm) Subsequently, the application liquid thus applied was dried at 130° C. for 30 minutes. Through the above process, an intermediate layer was formed to a thickness of 2 μm on the substrate (support having the shape of a drum).

(Formation of Charge Generating Layer)

To a solvent containing 40 parts by mass of propylene glycol monomethyl ether and 40 parts by mass of tetrahydrofuran, the following were added: 1.5 parts by mass of titanyl phthalocyanine (Y—TiOPc) and 1 part by mass of a polyvinyl acetal resin (S-LEC BX-5, product of Sekisui Chemical Co., Ltd.) as a base resin. The titanyl phthalocyanine added here exhibits a major peak at the Bragg angle $2\theta \pm 0.2° = 27.2°$ with respect to characteristic X-rays of CuKα. Subsequently, the materials added to the solvent were mixed for two hours by using a bead mill, causing the materials to be dispersed in the solvent. Through the above process, an application liquid for forming a charge generating layer was obtained.

Subsequently, the application liquid thus obtained was filtered using a 3 μm filter. The application liquid resulting from the filtration was applied by dip coating onto the intermediate layer formed through the above process. Subsequently, the application liquid thus applied was dried at 50° C. for 5 minutes. Through the above process, a charge generating layer was formed to a thickness of 0.3 μm on the intermediate layer.

(Formation of Charge Transport Layer)

To a solvent containing 350 parts by mass of tetrahydrofuran and 350 parts by mass of toluene, the following were added: 42 parts by mass of the hole transport material (CTM-1), 2 parts by mass of hindered phenol-based antioxidant (Irganox 1010, product of BASF), 100 parts by mass of the polycarbonate resin (Resin-3, viscosity average molecular weight: 51,000), 5 parts by mass of a biphenyl derivative (ADD-1), and 5 parts by mass of silica particulates surface treated with hexamethyldisilazane (Aerosil RX200, product of Nippon Aerosil Co., Ltd., number average primary particle diameter: 12 nm). Subsequently, the materials added to the solvent were mixed for 12 hours by using a circulating ultrasound disperser, dispersing the materials in the solvent. Through the above process, an application liquid for forming a charge transport layer was obtained.

Subsequently, the application liquid thus obtained was filtered using a 3 μm filter. The application liquid resulting from the filtration was applied by dip coating onto the charge generating layer formed through the above process. Subsequently, the application liquid thus applied was dried at 120° C. for 40 minutes. Through the above process, a charge transport layer was formed to a thickness of 30 μm on the charge generating layer. This completed the manufacture of a photosensitive member C-1 (multi-layer photosensitive member) having the intermediate layer, the charge generating layer, and the charge transport layer stacked on the substrate in the order stated.

[Method of Manufacturing Photosensitive Member C-2]

A photosensitive member C-2 (multi-layer photosensitive member) was manufactured in the same manner as the photosensitive member C-1 except that the hole transport material used was CTM-2 instead of CTM-1.

[Method of Manufacturing Photosensitive Member C-3]

A photosensitive member C-3 (multi-layer photosensitive member) was manufactured in the same manner as the photosensitive member C-1 except that the hole transport material used was CTM-3 instead of CTM-1.

[Method of Manufacturing Photosensitive Member C-4]

A photosensitive member C-4 (multi-layer photosensitive member) was manufactured in the same manner as the photosensitive member C-1 except that the hole transport material used was CTM-4 instead of CTM-1.

[Method of Manufacturing Photosensitive Member C-5]

A photosensitive member C-5 (multi-layer photosensitive member) was manufactured in the same manner as the photosensitive member C-1 except that the hole transport material used was CTM-5 instead of CTM-1.

[Method of Manufacturing Photosensitive Member C-6]

A photosensitive member C-6 (multi-layer photosensitive member) was manufactured in the same manner as the photosensitive member C-1 except that the hole transport material used was CTM-6 instead of CTM-1.

[Method of Manufacturing Photosensitive Member C-7]

A photosensitive member C-7 (multi-layer photosensitive member) was manufactured in the same manner as the photosensitive member C-1 except that the hole transport material used was CTM-7 instead of CTM-1.

[Method of Manufacturing Photosensitive Member C-8]

A photosensitive member C-8 (multi-layer photosensitive member) was manufactured in the same manner as the photosensitive member C-1 except that the hole transport material used was CTM-8 instead of CTM-1.

[Method of Manufacturing Photosensitive Member C-9]

A photosensitive member C-9 (multi-layer photosensitive member) was manufactured in the same manner as the photosensitive member C-1 except that the hole transport material used was CTM-9 instead of CTM-1.

[Method of Manufacturing Photosensitive Member C-10]

A photosensitive member C-10 (multi-layer photosensitive member) was manufactured in the same manner as the photosensitive member C-1 except that the hole transport material used was CTM-10 instead of CTM-1.

[Method of Manufacturing Photosensitive Member C-11]

A photosensitive member C-11 (multi-layer photosensitive member) was manufactured in the same manner as the photosensitive member C-1 except that the hole transport material used was CTM-11 instead of CTM-1.

[Method of Manufacturing Photosensitive Member C-12]

A photosensitive member C-12 (multi-layer photosensitive member) was manufactured in the same manner as the photosensitive member C-1 except that the hole transport material used was CTM-12 instead of CTM-1.

[Method of Manufacturing Photosensitive Member C-13]

A photosensitive member C-13 (multi-layer photosensitive member) was manufactured in the same manner as the photosensitive member C-1 except that the biphenyl derivative used was ADD-2 instead of ADD-1.

[Method of Manufacturing Photosensitive Member C-14]

A photosensitive member C-14 (multi-layer photosensitive member) was manufactured in the same manner as the photosensitive member C-1 except that the biphenyl derivative used was ADD-3 instead of ADD-1.

[Method of Manufacturing Photosensitive Member C-15]

A photosensitive member C-15 (multi-layer photosensitive member) was manufactured in the same manner as the photosensitive member C-1 except that the phenanthrene derivative ADD-4 was used instead of the biphenyl derivative ADD-1.

[Method of Manufacturing Photosensitive Member C-16]

A photosensitive member C-16 (multi-layer photosensitive member) was manufactured in the same manner as the photosensitive member C-1 except that the biphenyl derivative used was ADD-5 instead of ADD-1.

[Method of Manufacturing Photosensitive Member C-17]

A photosensitive member C-17 (multi-layer photosensitive member) was manufactured in the same manner as the photosensitive member C-1 except that the biphenyl derivative used was ADD-6 instead of ADD-1.

[Method of Manufacturing Photosensitive Member C-18]

A photosensitive member C-18 (multi-layer photosensitive member) was manufactured in the same manner as the photosensitive member C-1 except that the biphenyl derivative used was ADD-7 instead of ADD-1.

[Method of Manufacturing Photosensitive Member C-19]

A photosensitive member C-19 (multi-layer photosensitive member) was manufactured in the same manner as the photosensitive member C-1 except that the biphenyl derivative used was ADD-8 instead of ADD-1.

[Method of Manufacturing Photosensitive Member C-20]

A photosensitive member C-20 (multi-layer photosensitive member) was manufactured in the same manner as the photosensitive member C-1 except that the binder resin used was Resin-4 (viscosity average molecular weight: 50,500) instead of Resin-3.

[Method of Manufacturing Photosensitive Member C-21]

A photosensitive member C-21 (multi-layer photosensitive member) was manufactured in the same manner as the photosensitive member C-1 except that the binder resin used was Resin-5 (viscosity average molecular weight: 50,000) instead of Resin-3.

[Method of Manufacturing Photosensitive Member C-22]

A photosensitive member C-22 (multi-layer photosensitive member) was manufactured in the same manner as the photosensitive member C-1 except that the viscosity average molecular weight of the binder resin (Resin-3) was 40,000 instead of 51,000.

[Method of Manufacturing Photosensitive Member C-23]

A photosensitive member C-23 (multi-layer photosensitive member) was manufactured in the same manner as the photosensitive member C-1 except that the viscosity average molecular weight of the binder resin (Resin-3) was 32,500 instead of 51,000.

[Method of Manufacturing Photosensitive Member C-24]

A photosensitive member C-24 (multi-layer photosensitive member) was manufactured in the same manner as the photosensitive member C-1 except that the silica particulates used were Aerosil RX300 (number average primary particle diameter: 7 nm) instead of Aerosil RX200.

[Method of Manufacturing Photosensitive Member C-25]

A photosensitive member C-25 (multi-layer photosensitive member) was manufactured in the same manner as the photosensitive member C-1 except that the silica particulates used were Aerosil NAX50 (number average primary particle diameter: 50 nm) instead of Aerosil RX200.

[Method of Manufacturing Photosensitive Member C-26]

A photosensitive member C-26 (multi-layer photosensitive member) was manufactured in the same manner as the photosensitive member C-1 except that the additive amount of CTM-1 was 50 parts by mass instead of 42 parts by mass and that the silica particulates surface treated with dimethyldichlorosilane (Aerosil R974) were used instead of the silica particulates surface treated with hexamethyldisilazane (Aerosil RX200).

[Method of Manufacturing Photosensitive Member C-27]

A photosensitive member C-27 (multi-layer photosensitive member) was manufactured in the same manner as the photosensitive member C-1 except that the additive amount of CTM-1 was 50 parts by mass instead of 42 parts by mass and that the silica particulates surface treated with polydimethylsiloxane (Aerosil RY200) were used instead of the silica particulates surface treated with hexamethyldisilazane (Aerosil RX200).

[Method of Manufacturing Photosensitive Member C-28]

A photosensitive member C-28 (multi-layer photosensitive member) was manufactured in the same manner as the photosensitive member C-1 except that the additive amount of the silica particulates was 0.5 parts by mass instead of 5 parts by mass.

[Method of Manufacturing Photosensitive Member C-29]

A photosensitive member C-29 (multi-layer photosensitive member) was manufactured in the same manner as the photosensitive member C-1 except that the additive amount of the silica particulates was 2 parts by mass instead of 5 parts by mass.

[Method of Manufacturing Photosensitive Member C-30]

A photosensitive member C-30 (multi-layer photosensitive member) was manufactured in the same manner as the photosensitive member C-1 except that the additive amount of silica particulates was 10 parts by mass instead of 5 parts by mass.

[Method of Manufacturing Photosensitive Member C-31]

A photosensitive member C-31 (multi-layer photosensitive member) was manufactured in the same manner as the photosensitive member C-1 except that the additive amount of the silica particulates was 15 parts by mass instead of 5 parts by mass.

[Method of Manufacturing Photosensitive Member D-1]

A photosensitive member D-1 (multi-layer photosensitive member) was manufactured in the same manner as the photosensitive member C-1 except that none of a biphenyl derivative, a phenanthrene derivative, and silica particles was used.

[Method of Manufacturing Photosensitive Member D-2]

A photosensitive member D-2 (multi-layer photosensitive member) was manufactured in the same manner as the photosensitive member C-1 except that silica particles were not used.

[Evaluation Method]

The respective samples (the photosensitive members C-1 to D-2) were evaluated.

(Electrical Characteristics Evaluation)

Each sample (photosensitive member) was charged by a drum sensitivity test device manufactured by GEN-TECH, INC. at an initial charging of −800 V and a rotational speed of 31 rpm. Subsequently, the surface of the sample was irradiated with monochromatic light (wavelength: 780 nm, light quantity: 1.0 $\mu J/cm^2$) extracted from light of a halogen lamp through a bandpass filter. Upon passage of 50 msec from the irradiation with monochromatic light, the surface potential (residual potential $V_L$) of the sample was measured. The measurement was carried out in an environment with a temperature of 23° C. and a humidity of 50% RH.

(Oil Crack Resistance)

After oil (oleic triglyceride) was attached to the surface of the sample (photosensitive member) (more specifically, 10 measurement locations on the surface), the sample was left to stand for 2 days at a temperature of 23° C. and a humidity of 50% RH. Then, the surface of the sample was observed under an optical microscope to check for cracking at each measurement location. The oil crack resistance was evaluated in accordance with the following criteria.

Very Good: Cracking was observed at 0 locations.

Good: Cracking was observed at 1 to 3 locations.

Acceptable: Cracking was observed at 4 to 5 locations.

Poor: Cracking was observed at 6 locations or more.

(Abrasion Resistance Evaluation Before Expiry of Liquid Working Life)

Each of the sample (photosensitive member) prepared in the above manner was evaluated for its abrasion resistance by evaluating an application liquid for forming a corresponding charge transport layer (in the explanation of the abrasion resistance evaluation, the application liquid is simply referred to as an "evaluation application liquid"). More specifically, the evaluation application liquid (before expiry of its working life) was applied onto a 0.3 mm-thick polypropylene sheet wound around an aluminum pipe measuring 78 mm in diameter, followed by drying at 120° C. for 40 minutes. As a result, an evaluation sheet was formed to a thickness of 30 μm on the polypropylene sheet.

Subsequently, the evaluation sheet was removed from the polypropylene sheet. The evaluation sheet thus removed was attached to a specimen mounting card (S-36, product of TABER Industries) to prepare a specimen.

Subsequently, the mass $M_A$ of the specimen before the abrasion test was measured. Then, the abrasion test was performed on the sample. More specifically, the specimen was set on a rotary table of a rotary ablation tester (Toyo Seiki Seisaku-sho, Ltd.). The rotary table was rotated for 1,000 times at a rotational speed of 60 rpm, with an abrasion wheel (CS-10, product of TABER Industries) placed on the sample to apply a load of 500 gf.

Subsequently, the mass $M_B$ of the specimen after the abrasion test was measured. Then, the abrasion loss ($=M_A-M_B$) was determined as a difference between the mass of the sample before and after the abrasion test. Abrasion resistance was evaluated based on the abrasion loss which was measured. The measurement was carried out in an environment with a temperature of 23° C. and a humidity of 50% RH.

(Abrasion Resistance Evaluation After Expiry of Liquid Working Life)

Each of the sample (photosensitive member) prepared in the above manner was evaluated for its abrasion resistance by evaluating an application liquid for forming a corresponding charge transport layer (in the explanation of the abrasion resistance evaluation, the application liquid is simply referred to as an "evaluation application liquid"). The evaluation application liquid used here was after expiry of its working life. More specifically, deterioration of the evaluation application liquid was accelerated by using a roll mill and brought to the state after expiry of its working life (the state equivalent to 30 days after the manufacture of the evaluation application liquid).

Then, the abrasion test was performed on the evaluation application liquid that was after expiry of the working life to measure abrasion loss in the same manner as in the abrasion test before expiry of the working life. The measurement was carried out in an environment with a temperature of 23° C. and a humidity of 50% RH.

Table 4 shows the evaluation results (electrical characteristics (sensitivity), abrasion resistance, and oil crack resistance) of the respective samples (photosensitive members C-1 to D-2)

TABLE 4

| Photo-sensitive Member | Electrical Characteristics [V] | Oil Crack Resistance | Abrasion Loss Before Life Expiry [mg] | Abrasion Loss After Life Expiry [mg] |
|---|---|---|---|---|
| C-1 | 74 | Very Good | 5.3 | 5.4 |
| C-2 | 72 | Very Good | 5.5 | 5.4 |
| C-3 | 70 | Very Good | 5.5 | 5.4 |

TABLE 4-continued

| Photo-sensitive Member | Electrical Characteristics [V] | Oil Crack Resistance | Abrasion Loss Before Life Expiry [mg] | Abrasion Loss After Life Expiry [mg] |
|---|---|---|---|---|
| C-4 | 70 | Very Good | 5.3 | 5.6 |
| C-5 | 54 | Good | 5.2 | 5.4 |
| C-6 | 77 | Good | 5.1 | 5.3 |
| C-7 | 70 | Good | 5.4 | 5.4 |
| C-8 | 99 | Very Good | 5.2 | 5.2 |
| C-9 | 95 | Good | 5.4 | 5.2 |
| C-10 | 50 | Very Good | 5.0 | 5.3 |
| C-11 | 115 | Very Good | 5.4 | 5.4 |
| C-12 | 110 | Acceptable | 5.0 | 5.2 |
| C-13 | 72 | Very Good | 5.2 | 5.2 |
| C-14 | 70 | Very Good | 5.2 | 5.4 |
| C-15 | 71 | Very Good | 5.0 | 5.3 |
| C-16 | 69 | Good | 5.5 | 5.3 |
| C-17 | 75 | Very Good | 5.5 | 5.4 |
| C-18 | 73 | Very Good | 5.2 | 5.2 |
| C-19 | 70 | Very Good | 5.0 | 5.2 |
| C-20 | 70 | Very Good | 4.7 | 5.2 |
| C-21 | 75 | Very Good | 3.7 | 3.6 |
| C-22 | 74 | Good | 4.7 | 5.0 |
| C-23 | 75 | Acceptable | 5.8 | 6.1 |
| C-24 | 69 | Very Good | 5.4 | 5.4 |
| C-25 | 70 | Very Good | 5.0 | 5.0 |
| C-26 | 75 | Acceptable | 5.3 | 5.3 |
| C-27 | 78 | Acceptable | 5.5 | 5.5 |
| C-28 | 74 | Very Good | 5.5 | 5.7 |
| C-29 | 74 | Very Good | 5.1 | 5.3 |
| C-30 | 74 | Good | 5.4 | 5.4 |
| C-31 | 69 | Good | 5.1 | 5.3 |
| D-1 | 83 | Good | 7.5 | 7.7 |
| D-2 | 75 | Very Good | 7.7 | 7.8 |

As shown in Table 4, the photosensitive members C-1 to C-31 (the photosensitive members according to Examples of the present disclosure) each exhibited that the residual potential was no greater than 120 V, the abrasion loss before expiry of liquid working life was no greater than 6.0 mg, the abrasion loss after expiry of liquid working life was no greater than 6.5 mg, and cracking was observed at no greater than 5 locations.

Evaluation 3

The following explains Evaluation 3. Table 5 shows photosensitive members E-1 to E-25 and F-1 to F-2 (each of which is an electrophotographic photosensitive member) subjected to Evaluation 3.

TABLE 5

| Photo-sensitive Member | Charge Transport Material: Binder Resin (Molecular Weight) | Hole Transport Material: Type | Hole Transport Material: Amount | Pigment: Type | Pigment: Amount | Silica Particles: Type | Silica Particles: Surface Treatment | Silica Particles: Amount |
|---|---|---|---|---|---|---|---|---|
| E-1 | Resin-3 | CTM-1 | 50 | x-$H_2$Pc | 0.4 | RX200 | HMDS | 5.0 |
| E-2 | (51,000) | CTM-2 | | | | (12 nm) | | |
| E-3 | | CTM-3 | | | | | | |
| E-4 | | CTM-4 | | | | | | |
| E-5 | | CTM-5 | | | | | | |
| E-6 | | CTM-6 | | | | | | |
| E-7 | | CTM-7 | | | | | | |
| E-8 | | CTM-8 | | | | | | |
| E-9 | | CTM-9 | | | | | | |
| E-10 | | CTM-10 | | | | | | |
| E-11 | | CTM-11 | | | | | | |
| E-12 | | CTM-12 | | | | | | |
| E-13 | Resin-3 | CTM-1 | 50 | Y-TiOPc | 0.4 | RX200 | HMDS | 5.0 |
| E-14 | (51,000) | | | α-TiOPc | | (12 nm) | | |
| E-15 | | | | ϵ-CuPc | | | | |

TABLE 5-continued

| Photo-sensitive Member | Binder Resin (Molecular Weight) | Charge Transport Material: Hole Transport Material Type | Amount | Pigment Type | Amount | Silica Particles Type | Surface Treatment | Amount |
|---|---|---|---|---|---|---|---|---|
| E-16 | Resin-4 (50,500) | | | x-$H_2$Pc | | | | |
| E-17 | Resin-5 (50,000) | | | x-$H_2$Pc | | | | |
| E-18 | Resin-3 (40,000) | | | x-$H_2$Pc | | | | |
| E-19 | Resin-3 (32,500) | | | | | | | |
| E-20 | Resin-3 (51,000) | | | | | RX300 (7 nm) | | |
| E-21 | Resin-3 (51,000) | | | | | NAX50 (50 nm) | | |
| E-22 | Resin-3 | CTM-1 | 50 | x-$H_2$Pc | 0.4 | RX200 | | 0.5 |
| E-23 | (51,000) | | | | | (12 nm) | | 2.0 |
| E-24 | | | | | | | | 10.0 |
| E-25 | | | | | | | | 15.0 |
| F-1 | Resin-3 | CTM-1 | 50 | — | — | — | — | — |
| F-2 | (51,000) | | | x-$H_2$Pc | 0.4 | — | — | — |

[Method of Manufacturing Photosensitive Member E-1]

(Formation of Intermediate Layer)

First, surface-treated particles of titanium oxide (SMT-A, test product of TAYCA CORPORATION, number average primary particle diameter: 10 nm) were prepared. More specifically, particles of titanium oxide were surface treated with alumina and silica, and then the surface-treated particles of titanium oxide were further surface treated with methyl hydrogen polysiloxane during wet dispersion by a bead mill. As a result, particles of titanium oxide for forming an intermediate layer were obtained.

Subsequently, to a solvent containing 10 parts by mass of methanol, 1 part by mass of butanol, and 1 part by mass of toluene, the following were added: 2 parts by mass of the titanium oxide particles prepared through the process described above and 1 part by mass of a four-component copolymer polyamide resin of polyamide 6, polyamide 12, polyamide 66, and polyamide 610 (Nylon resin Amilan CM8000, product of Toray Industries, Inc.). Subsequently, the materials added to the solvent were mixed for five hours by using a bead mill, causing the materials to be dispersed in the solvent. Through the above process, an application liquid for forming an intermediate layer was obtained.

Subsequently, the application liquid thus obtained was filtered using a 5 μm filter. The application liquid resulting from the filtration was applied by dip coating onto an aluminum support having the shape of a drum (diameter: 30 mm, and length: 246 mm) Subsequently, the application liquid thus applied was dried at 130° C. for 30 minutes. Through the above process, an intermediate layer was formed to a thickness of 2 μm on the substrate (support having the shape of a drum).

(Formation of Charge Generating Layer)

To a solvent containing 40 parts by mass of propylene glycol monomethyl ether and 40 parts by mass of tetrahydrofuran, the following were added: 1.5 parts by mass of titanyl phthalocyanine (Y—TiOPc) and 1 part by mass of a polyvinyl acetal resin (S-LEC BX-5, product of Sekisui Chemical Co., Ltd.) as a base resin. The titanyl phthalocyanine (Y—TiOPc) added exhibits a major peak at the Bragg angle 2θ±0.2°=27.2° with respect to characteristic X-rays of CuKα. Subsequently, the materials added to the solvent were mixed for two hours by using a bead mill, causing the materials to be dispersed in the solvent. Through the above process, an application liquid for forming a charge generating layer was obtained.

Subsequently, the application liquid thus obtained was filtered using a 3 μm filter. The application liquid resulting from the filtration was applied by dip coating onto the intermediate layer formed through the above process. Subsequently, the application liquid thus applied was dried at 50° C. for 5 minutes. Through the above process, a charge generating layer was formed to a thickness of 0.3 μm on the intermediate layer.

(Formation of Charge Transport Layer)

To a solvent containing 350 parts by mass of tetrahydrofuran and 350 parts by mass of toluene, the following were added: 50 parts by mass of the hole transport material (CTM-1), 2 parts by mass of a hindered phenol-based antioxidant (Irganox 1010, product of BASF), 100 parts by mass of the polycarbonate resin (Resin-3, viscosity average molecular weight: 51,000) as he binder resin, 0.4 parts by mass of X-type metal-free phthalocyanine (x-$H_2$Pc) pigment (FASTOGEN Blue 8120BS, product of DIC Corporation), and 5 parts by mass of silica particulates surface treated with hexamethyldisilazane (Aerosil RX200, product of Nippon Aerosil Co., Ltd., number average primary particle diameter: 12 nm). Subsequently, the materials added to the solvent were mixed for 12 hours by using a circulating ultrasound disperser to disperse the materials in the solvent. Through the above process, an application liquid for forming a charge transport layer was obtained.

Subsequently, the application liquid thus obtained was filtered using a 3 μm filter. The application liquid resulting from the filtration was applied by dip coating onto the charge generating layer formed through the above process. Subsequently, the application liquid thus applied was dried at 120° C. for 40 minutes. Through the above process, a charge transport layer was formed to a thickness of 30 μm on the charge generating layer. This completed the manufacture of a photosensitive member E-1 (multi-layer photosensitive member) having the intermediate layer, the charge generating layer, and the charge transport layer stacked on the substrate in the order stated.

(Method of Manufacturing Photosensitive Member E-2)

A photosensitive member E-2 (multi-layer photosensitive member) was manufactured in the same manner as the photosensitive member E-1 except that the hole transport material used was CTM-2 instead of CTM-1.

(Method of Manufacturing Photosensitive Member E-3)

A photosensitive member E-3 (multi-layer photosensitive member) was manufactured in the same manner as the photosensitive member E-1 except that the hole transport material used was CTM-3 instead of CTM-1.

(Method of Manufacturing Photosensitive Member E-4)

A photosensitive member E-4 (multi-layer photosensitive member) was manufactured in the same manner as the photosensitive member E-1 except that the hole transport material used was CTM-4 instead of CTM-1.

(Method of Manufacturing Photosensitive Member E-5)

A photosensitive member E-5 (multi-layer photosensitive member) was manufactured in the same manner as the photosensitive member E-1 except that the hole transport material used was CTM-5 instead of CTM-1.

(Method of Manufacturing Photosensitive Member E-6)

A photosensitive member E-6 (multi-layer photosensitive member) was manufactured in the same manner as the photosensitive member E-1 except that the hole transport material used was CTM-6 instead of CTM-1.

(Method of Manufacturing Photosensitive Member E-7)

A photosensitive member E-7 (multi-layer photosensitive member) was manufactured in the same manner as the photosensitive member E-1 except that the hole transport material used was CTM-7 instead of CTM-1.

(Method of Manufacturing Photosensitive Member E-8)

A photosensitive member E-8 (multi-layer photosensitive member) was manufactured in the same manner as the photosensitive member E-1 except that the hole transport material used was CTM-8 instead of CTM-1.

(Method of Manufacturing Photosensitive Member E-9)

A photosensitive member E-9 (multi-layer photosensitive member) was manufactured in the same manner as the photosensitive member E-1 except that the hole transport material used was CTM-9 instead of CTM-1.

(Method of Manufacturing Photosensitive Member E-10)

A photosensitive member E-10 (multi-layer photosensitive member) was manufactured in the same manner as the photosensitive member E-1 except that the hole transport material used was CTM-10 instead of CTM-1.

(Method of Manufacturing Photosensitive Member E-11)

A photosensitive member E-11 (multi-layer photosensitive member) was manufactured in the same manner as the photosensitive member E-1 except that the hole transport material used was CTM-11 instead of CTM-1.

(Method of Manufacturing Photosensitive Member E-12)

A photosensitive member E-12 (multi-layer photosensitive member) was manufactured in the same manner as the photosensitive member E-1 except that the hole transport material used was CTM-12 instead of CTM-1.

(Method of Manufacturing Photosensitive Member E-13)

A photosensitive member E-13 (multi-layer photosensitive member) was manufactured in the same manner as the photosensitive member E-1 except that the pigment added to the charge transport layer was a Y-type titanyl phthalocyanine (Y—TiOPc) pigment instead of the X-type metal-free phthalocyanine pigment.

(Method of Manufacturing Photosensitive Member E-14)

A photosensitive member E-14 (multi-layer photosensitive member) was manufactured in the same manner as the photosensitive member E-1 except that the pigment added to the charge transport layer was an α-type titanyl phthalocyanine (α-TiOPc) pigment instead of the X-type metal-free phthalocyanine pigment.

(Method of Manufacturing Photosensitive Member E-15)

A photosensitive member E-15 (multi-layer photosensitive member) was manufactured in the same manner as the photosensitive member E-1 except that the pigment added to the charge transport layer was an ϵ-type copper phthalocyanine (ϵ-CuPc) pigment instead of the X-type metal-free phthalocyanine pigment.

(Method of Manufacturing Photosensitive Member E-16)

A photosensitive member E-16 (multi-layer photosensitive member) was manufactured in the same manner as the photosensitive member E-1 except that the binder resin used was Resin-4 (viscosity average molecular weight: 50,500) instead of Resin-3.

(Method of Manufacturing Photosensitive Member E-17)

A photosensitive member E-17 (multi-layer photosensitive member) was manufactured in the same manner as the photosensitive member E-1 except that the binder resin used was Resin-5 (viscosity average molecular weight: 50,000) instead of Resin-3.

(Method of Manufacturing Photosensitive Member E-18)

A photosensitive member E-18 (multi-layer photosensitive member) was manufactured in the same manner as the photosensitive member E-1 except that the viscosity average molecular weight of the binder resin (Resin-3) was 40,000 instead of 51,000.

(Method of Manufacturing Photosensitive Member E-19)

A photosensitive member E-19 (multi-layer photosensitive member) was manufactured in the same manner as the photosensitive member E-1 except that the viscosity average molecular weight of the binder resin (Resin-3) was 32,500 instead of 51,000.

(Method of Manufacturing Photosensitive Member E-20)

A photosensitive member E-20 (multi-layer photosensitive member) was manufactured in the same manner as the photosensitive member E-1 except that the silica particulates used were Aerosil RX300 (number average primary particle diameter: 7 nm) instead of Aerosil RX200.

(Method of Manufacturing Photosensitive Member E-21)

A photosensitive member E-21 (multi-layer photosensitive member) was manufactured in the same manner as the photosensitive member E-1 except that the silica particulates used were Aerosil NAX50 (number average primary particle diameter: 50 nm) instead of Aerosil RX200.

(Method of Manufacturing Photosensitive Member E-22)

A photosensitive member E-22 (multi-layer photosensitive member) was manufactured in the same manner as the photosensitive member E-1 except that the additive amount of the silica particulates was 0.5 parts by mass instead of 5 parts by mass.

(Method of Manufacturing Photosensitive Member E-23)

A photosensitive member E-23 (multi-layer photosensitive member) was manufactured in the same manner as the photosensitive member E-1 except that the additive amount of the silica particulates was 2 parts by mass instead of 5 parts by mass.

(Method of Manufacturing Photosensitive Member E-24)

A photosensitive member (multi-layer photosensitive member) E-24 was manufactured in the same manner as the photosensitive member E-1 except that the additive amount of the silica particulates was 10 parts by mass instead of 5 parts by mass.

(Method of Manufacturing Photosensitive Member E-25)

A photosensitive member (multi-layer photosensitive member) E-25 was manufactured in the same manner as the photosensitive member E-1 except that the additive amount of the silica particulates was 15 parts by mass instead of 5 parts by mass.

(Method of Manufacturing Photosensitive Member F-1)

A photosensitive member (multi-layer photosensitive member) F-1 was manufactured in the same manner as the photosensitive member E-1 except that neither a phthalocyanine pigment nor silica particulates was used.

(Method of Manufacturing Photosensitive Member F-2)

A photosensitive member (multi-layer photosensitive member) F-2 was manufactured in the same manner as the photosensitive member E-1 except that silica particles were not used.

[Evaluation Method]

The respective samples (photosensitive members E-1 to F-2) were evaluated.

(Electrical Characteristics Evaluation Before Expiry of Liquid Working Life)

Each sample (photosensitive member) was charged by a drum sensitivity test device manufactured by GEN-TECH, INC. at an initial charging of −800 V and a rotational speed of 31 rpm. Subsequently, the surface of the sample was irradiated with monochromatic light (wavelength: 780 nm, light quantity: 1.0 μJ/cm$^2$) extracted from light of a halogen lamp through a bandpass filter. Upon passage of 50 msec from the irradiation with monochromatic light, the surface potential (residual potential $V_L$) of the sample was measured. In addition, the half-decay exposure $E_{1/2}$ referring to the quantity of light exposed to reduce the initial surface potential to half (½) was measured. To measure the half-decay exposure $E_{1/2}$, the quantity of monochromatic light exposed was varied within a range of 0.05 μJ/cm$^2$ to 1.0 μJ/cm$^2$. The measurement was carried out in an environment with a temperature of 23° C. and a humidity of 50% RH.

(Electrical Characteristics Evaluation after Expiry of Liquid Working Life)

Each of the sample (photosensitive member) prepared in the above manner was evaluated for its abrasion resistance by evaluating an application liquid for forming a corresponding charge transport layer (in the explanation of the abrasion resistance evaluation, the application liquid is simply referred to as an "evaluation application liquid") that was after expiry of its working life. More specifically, deterioration of the evaluation application liquid was accelerated by using a roll mill and brought to the state after expiry of its working life (the state equivalent to 30 days after the manufacture of the evaluation application liquid).

Then, in the same manner as in the electrical characteristics evaluation before expiry of the working life, the evaluation application liquid that was after expiry of the working life was subjected to the test to measure the residual potential $V_L$ and the half-decay exposure $E_{1/2}$. The measurement was carried out in an environment with a temperature of 23° C. and a humidity of 50% RH.

(Abrasion Resistance Evaluation)

Each of the sample (photosensitive member) prepared in the above manner was evaluated for its abrasion resistance by evaluating an application liquid for forming a corresponding charge transport layer (in the explanation of the abrasion resistance evaluation, the application liquid is simply referred to as an "evaluation application liquid"). More specifically, the evaluation application liquid was applied onto a 0.3 mm-thick polypropylene sheet wound around an aluminum pipe measuring 78 mm in diameter, followed by drying at 120° C. for 40 minutes. As a result, an evaluation sheet was formed to a thickness of 30 μm on the polypropylene sheet.

Subsequently, the evaluation sheet was removed from the polypropylene sheet. The evaluation sheet thus removed was attached to a specimen mounting card (S-36, product of TABER Industries) to prepare a specimen.

Subsequently, the mass $M_A$ of the specimen before the abrasion test was measured. Then, the abrasion test was performed on the sample. More specifically, the specimen was set on a rotary table of a rotary ablation tester (Toyo Seiki Seisaku-sho, Ltd.). The rotary table was rotated for 1,000 times at a rotational speed of 60 rpm, with an abrasion wheel (CS-10, product of TABER Industries) placed on the sample to apply a load of 500 gf.

Subsequently, the mass $M_B$ of the specimen after the abrasion test was measured. Then, the abrasion loss ($=M_A-M_B$) was determined as a difference between the mass of the sample before and after the abrasion test. Abrasion resistance was evaluated based on the abrasion loss which was measured.

Table 6 shows the evaluation results (electrical characteristics (sensitivity) and abrasion resistance) of the respective samples (photosensitive members E-1 to F-2)

TABLE 6

| Photosensitive Member | Electrical Characteristics: Before Expiry of Liquid Life $E_{1/2}$ [μJ/cm$^2$] | Before Expiry of Liquid Life $V_L$ [V] | After Expiry of Liquid Life $E_{1/2}$ [μJ/cm$^2$] | After Expiry of Liquid Life $V_L$ [V] | Change Amount $\Delta E_{1/2}$ [μJ/cm$^2$] | Abrasion Resistance: Abrasion Loss [mg] |
|---|---|---|---|---|---|---|
| E-1 | 0.218 | 72 | 0.198 | 75 | −0.020 | 5.4 |
| E-2 | 0.214 | 69 | 0.200 | 76 | −0.014 | 5.6 |
| E-3 | 0.190 | 71 | 0.177 | 75 | −0.013 | 5.1 |
| E-4 | 0.180 | 69 | 0.178 | 72 | −0.002 | 4.9 |
| E-5 | 0.207 | 50 | 0.190 | 51 | −0.017 | 5.4 |
| E-6 | 0.180 | 75 | 0.180 | 75 | 0.000 | 5.0 |
| E-7 | 0.193 | 67 | 0.204 | 80 | 0.011 | 4.9 |
| E-8 | 0.190 | 100 | 0.170 | 105 | −0.020 | 5.9 |
| E-9 | 0.190 | 95 | 0.200 | 98 | 0.010 | 5.0 |
| E-10 | 0.191 | 49 | 0.193 | 50 | 0.002 | 5.1 |
| E-11 | 0.204 | 120 | 0.205 | 122 | 0.001 | 5.2 |
| E-12 | 0.198 | 114 | 0.197 | 117 | −0.001 | 5.3 |
| E-13 | 0.180 | 67 | 0.200 | 76 | 0.020 | 5.9 |
| E-14 | 0.190 | 67 | 0.170 | 78 | −0.020 | 5.5 |
| E-15 | 0.199 | 71 | 0.210 | 83 | 0.011 | 5.3 |
| E-16 | 0.211 | 71 | 0.190 | 71 | −0.021 | 4.2 |
| E-17 | 0.189 | 80 | 0.171 | 71 | −0.018 | 3.2 |
| E-18 | 0.200 | 75 | 0.180 | 77 | −0.020 | 5.5 |
| E-19 | 0.200 | 79 | 0.155 | 82 | −0.045 | 6.2 |
| E-20 | 0.210 | 69 | 0.190 | 70 | −0.020 | 5.0 |
| E-21 | 0.189 | 67 | 0.185 | 75 | −0.004 | 6.0 |
| E-22 | 0.200 | 74 | 0.160 | 71 | −0.040 | 6.2 |
| E-23 | 0.215 | 70 | 0.196 | 72 | −0.019 | 5.9 |
| E-24 | 0.184 | 71 | 0.180 | 71 | −0.004 | 5.5 |
| E-25 | 0.180 | 70 | 0.180 | 80 | 0.000 | 5.9 |
| F-1 | 0.079 | 72 | 0.080 | 74 | 0.001 | 7.5 |
| F-2 | 0.200 | 76 | 0.130 | 76 | −0.070 | 7.7 |

As shown in Table 6, the photosensitive members E-1 to E-25 (the photosensitive members according to Examples of the present disclosure) each exhibited that the half-decay exposure $E_{1/2}$ before expiry of the liquid working life was at least 0.180 μJ/cm$^2$ and no greater than 0.220 μJ/cm$^2$, that the difference $\Delta E_{1/2}$ in the half-decay exposure $E_{1/2}$ between before and after expiry of the liquid working life was within a range of −0.05 μJ/cm$^2$ and 0.05 μJ/cm$^2$, and the abrasion loss was no greater than 7.0 mg.

Evaluation 4

The following explains Evaluation 4. Table 7 shows photosensitive members G-1 to G-24 and H-1 (each of which is an electrophotographic photosensitive member) subjected to Evaluation 4.

TABLE 7

| | Charge Transport Material | | | | | | |
|---|---|---|---|---|---|---|---|
| | | | | Silica Particles | | | |
| Photo-sensitive | Hole Transport | Silicone Oil | | | Surface Treatment | Particle Diameter | |
| Member | Material | Type | Amount | Type | Agent | [nm] | Amount |
| G-1 | CTM-1 | Oil-1 | 0.6 | RX200 | HMDS | 12 | 5.0 |
| G-2 | CTM-2 | | | | | | |
| G-3 | CTM-3 | | | | | | |
| G-4 | CTM-4 | | | | | | |
| G-5 | CTM-5 | | | | | | |
| G-6 | CTM-6 | | | | | | |
| G-7 | CTM-7 | | | | | | |
| G-8 | CTM-8 | | | | | | |
| G-9 | CTM-9 | | | | | | |
| G-10 | CTM-10 | | | | | | |
| G-11 | CTM-1 | Oil-2 | 0.6 | RX200 | HMDS | 12 | 5.0 |
| G-12 | | Oil-1 | 0.5 | | | | |
| G-13 | | | 0.9 | | | | |
| G-14 | | | 1.5 | | | | |
| G-15 | | | 0.6 | RX300 | | 7 | |
| G-16 | | | 0.6 | NAX50 | | 50 | |
| G-17 | CTM-1 | Oil-1 | 0.6 | R974 | DMDCS | 12 | 5.0 |
| G-18 | | | | RY200 | PDMS | | |
| G-19 | | | | RX200 | HMDS | 12 | 0.5 |
| G-20 | | | | | | | 2.0 |
| G-21 | | | | | | | 10.0 |
| G-22 | | | | | | | 15.0 |
| G-23 | | | | SX110 | | 110 | 5.0 |
| G-24 | | | | SX300 | | 300 | 5.0 |
| H-1 | CTM-1 | Oil-1 | 0.6 | | None | | |

[Method of Manufacturing Photosensitive Member G-1]

First, surface-treated particles of titanium oxide (SMT-A, number average primary particle diameter: 10 nm) were prepared. More specifically, particles of titanium oxide were surface treated with alumina and silica, and then the surface-treated particles of titanium oxide were further surface treated with methyl hydrogen polysiloxane during wet dispersion by a bead mill. As a result, particles of titanium oxide for forming an intermediate layer were obtained.

Subsequently, to a solvent containing 10 parts by mass of methanol, 1 part by mass of butanol, and 1 part by mass of toluene, the following were added: 2 parts by mass of the titanium oxide particles prepared through the process described above and 1 part by mass of a four-component copolymer polyamide resin of polyamide 6, polyamide 12, polyamide 66, and polyamide 610 (Nylon resin Amilan CM8000, product of Toray Industries, Inc.). Subsequently, the materials added to the solvent were mixed for five hours by using a bead mill, causing the materials to be dispersed in the solvent. Through the above process, an application liquid for forming an intermediate layer was obtained.

Subsequently, the application liquid thus obtained was filtered using a 5 μm filter. The application liquid resulting from the filtration was applied by dip coating onto an aluminum support having the shape of a drum (diameter: 30 mm, and length: 246 mm) Subsequently, the application liquid thus applied was dried at 130° C. for 30 minutes. Through the above process, an intermediate layer was formed to a thickness of 2 μm on the substrate (support having the shape of a drum).

(Formation of Charge Generating Layer)

To a solvent containing 40 parts by mass of propylene glycol monomethyl ether and 40 parts by mass of tetrahydrofuran, the following were added: 1.5 parts by mass of titanyl phthalocyanine (Y—TiOPc) and 1 part by mass of a polyvinyl acetal resin (S-LEC BX-5, product of Sekisui Chemical Co., Ltd.) as a base resin. The titanyl phthalocyanine added here at least exhibits a major peak at the Bragg angle 2θ±0.2°=27.2° with respect to characteristic X-rays of CuKα. Subsequently, the materials added to the solvent were mixed for two hours by using a bead mill, causing the materials to be dispersed in the solvent. Through the above process, an application liquid for forming a charge generating layer was obtained.

Subsequently, the application liquid thus obtained was filtered using a 3 μm filter. The application liquid resulting from the filtration was applied by dip coating onto the intermediate layer formed through the above process. Subsequently, the application liquid thus applied was dried at 50° C. for 5 minutes. Through the above process, a charge generating layer was formed to a thickness of 0.3 μm on the intermediate layer.

(Formation of Charge Transport Layer)

To a solvent containing 350 parts by mass of tetrahydrofuran and 350 parts by mass of toluene, the following were added: 60 parts by mass of the hole transport material (CTM-1), 2 parts by mass of hindered phenol-based antioxidant (Irganox 1010, product of BASF), 100 parts by mass of the polycarbonate resin (Resin-3, viscosity average molecular weight: 45,000) as the binder resin, 5 parts by mass of silica particulates surface treated with hexamethyldisilazane (Aerosil RX200, product of Nippon Aerosil Co., Ltd., number average primary particle diameter: 12 nm), and 0.6 parts by mass of the silicone oil represented by Formula (Oil-1) below (KF96-50CS, product of Shin-Etsu Chemical Co., Ltd.) as a leveling agent. Subsequently, the materials added to the solvent were mixed for 12 hours by using a circulating ultrasound disperser to disperse the materials in the solvent. Through the above process, an application liquid for forming a charge transport layer was obtained.

(Oil-1)

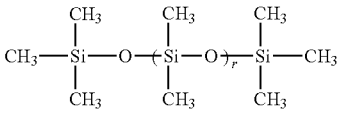

Subsequently, the application liquid thus obtained was filtered using a 3 μm filter. The application liquid resulting from the filtration was applied by dip coating onto the charge generating layer formed through the above process. Subsequently, the application liquid thus applied was dried at 120° C. for 40 minutes. Through the above process, a charge transport layer was formed to a thickness of 30 μm on the charge generating layer. This completed the formation of a photosensitive member G-1 (multi-layer photosensitive member) having the intermediate layer, the charge generating layer, and the charge transport layer stacked on the substrate in the order stated.

[Method of Manufacturing Photosensitive Member G-2]

A photosensitive member G-2 (multi-layer photosensitive member) was manufactured in the same manner as the photosensitive member G-1 except that the hole transport material used was CTM-2 instead of CTM-1.

[Method of Manufacturing Photosensitive Member G-3]

A photosensitive member G-3 (multi-layer photosensitive member) was manufactured in the same manner as the photosensitive member G-1 except that the hole transport material used was CTM-3 instead of CTM-1.

[Method of Manufacturing Photosensitive Member G-4]

A photosensitive member G-4 (multi-layer photosensitive member) was manufactured in the same manner as the photosensitive member G-1 except that the hole transport material used was CTM-4 instead of CTM-1.

[Method of Manufacturing Photosensitive Member G-5]

A photosensitive member G-5 (multi-layer photosensitive member) was manufactured in the same manner as the photosensitive member G-1 except that the hole transport material used was CTM-5 instead of CTM-1.

[Method of Manufacturing Photosensitive Member G-6]

A photosensitive member G-6 (multi-layer photosensitive member) was manufactured in the same manner as the photosensitive member G-1 except that the hole transport material used was CTM-6 instead of CTM-1.

[Method of Manufacturing Photosensitive Member G-7]

A photosensitive member G-7 (multi-layer photosensitive member) was manufactured in the same manner as the photosensitive member G-1 except that the hole transport material used was CTM-7 instead of CTM-1.

[Method of Manufacturing Photosensitive Member G-8]

A photosensitive member G-8 (multi-layer photosensitive member) was manufactured in the same manner as the photosensitive member G-1 except that the hole transport material used was CTM-8 instead of CTM-1.

[Method of Manufacturing Photosensitive Member G-9]

A photosensitive member G-9 (multi-layer photosensitive member) was manufactured in the same manner as the photosensitive member G-1 except that the hole transport material used was CTM-9 instead of CTM-1.

[Method of Manufacturing Photosensitive Member G-10]

A photosensitive member G-10 (multi-layer photosensitive member) was manufactured in the same manner as the photosensitive member G-1 except that the hole transport material used was CTM-10 instead of CTM-1.

[Method of Manufacturing Photosensitive Member G-11]

A photosensitive member G-11 (multi-layer photosensitive member) was manufactured in the same manner as the photosensitive member G-1 except that the leveling agent used was a silicone oil represented by Formula (Oil-2) below (FL-5 (fluoroalkyl-modified silicone oil), product of Shin-Etsu Chemical Co., Ltd.), instead of Oil-1.

(Oil-2)

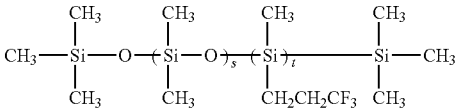

[Method of Manufacturing Photosensitive Member G-12]

A photosensitive member G-12 (multi-layer photosensitive member) was manufactured in the same manner as the photosensitive member G-1 except that the amount of Oil-1 used was 0.5 parts by mass relative to 100 parts by mass of the binder resin.

[Method of Manufacturing Photosensitive Member G-13]

A photosensitive member G-13 (multi-layer photosensitive member) was manufactured in the same manner as the photosensitive member G-1 except that the amount of Oil-1 used was 0.9 parts by mass relative to 100 parts by mass of the binder resin.

[Method of Manufacturing Photosensitive Member G-14]

A photosensitive member G-14 (multi-layer photosensitive member) was manufactured in the same manner as the photosensitive member G-1 except that the amount of Oil-1 used was 1.5 parts by mass relative to 100 parts by mass of the binder resin.

[Method of Manufacturing Photosensitive Member G-15]

A photosensitive member G-15 (multi-layer photosensitive member) was manufactured in the same manner as the photosensitive member G-1 except that silica particulates surface treated with hexamethyldisilazane (Aerosil RX300, product of Nippon Aerosil Co., Ltd., number average primary particle diameter: 7 nm) were used instead of Aerosil RX200.

[Method of Manufacturing Photosensitive Member G-16]

A photosensitive member G-16 (multi-layer photosensitive member) was manufactured in the same manner as the photosensitive member G-1 except that silica particulates surface treated with hexamethyldisilazane (Aerosil NAX50, product of Nippon Aerosil Co., Ltd., number average primary particle diameter: 50 nm) were used instead of Aerosil RX200.

[Method of Manufacturing Photosensitive Member G-17]

A photosensitive member G-17 (multi-layer photosensitive member) was manufactured in the same manner as the photosensitive member G-1 except that silica particulates surface treated with dimethyldichlorosilane (Aerosil R974, product of Nippon Aerosil Co., Ltd., number average primary particle diameter: 12 nm) were used instead of Aerosil RX200.

[Method of Manufacturing Photosensitive Member G-18]

A photosensitive member G-18 (multi-layer photosensitive member) was manufactured in the same manner as the photosensitive member G-1 except that silica particulates surface treated with polydimethylsiloxane (Aerosil RY200, product of Nippon Aerosil Co., Ltd., number average primary particle diameter: 12 nm) were used instead of Aerosil RX200.

[Method of Manufacturing Photosensitive Member G-19]

A photosensitive member G-19 (multi-layer photosensitive member) was manufactured in the same manner as the photosensitive member G-1 except that the amount of Aerosil RX200 used as the silica particulates was 0.5 parts by mass relative to 100 parts by mass of the binder resin.

[Method of Manufacturing Photosensitive Member G-20]

A photosensitive member G-20 (multi-layer photosensitive member) was manufactured in the same manner as the photosensitive member G-1 except that the amount of Aerosil RX200 used as the silica particulates was 2 parts by mass relative to 100 parts by mass of the binder resin.

[Method of Manufacturing Photosensitive Member G-21]

A photosensitive member G-21 (multi-layer photosensitive member) was manufactured in the same manner as the photosensitive member G-1 except that the amount of Aerosil RX200 used as the silica particulates was 10 parts by mass relative to 100 parts by mass of the binder resin.

[Method of Manufacturing Photosensitive Member G-22]

A photosensitive member G-22 (multi-layer photosensitive member) was manufactured in the same manner as the photosensitive member G-1 except that the amount of Aerosil RX200 used as the silica particulates was 15 parts by mass relative to 100 parts by mass of the binder resin.

[Method of Manufacturing Photosensitive Member G-23]

A photosensitive member G-23 (multi-layer photosensitive member) was manufactured in the same manner as the photosensitive member G-1 except that silica particulates surface treated with hexamethyldisilazane (test product 1: number average primary particle diameter: 110 nm) were used instead of Aerosil RX200.

[Method of Manufacturing Photosensitive Member G-24]

A photosensitive member G-24 (multi-layer photosensitive member) was manufactured in the same manner as the photosensitive member G-1 except that silica particulates surface treated with hexamethyldisilazane (test product 2: number average primary particle diameter: 300 nm) were used instead of Aerosil RX200.

[Method of Manufacturing Photosensitive Member H-1]

A photosensitive member (multi-layer photosensitive member) H-1 was manufactured in the same manner as the photosensitive member G-1 except that the silica particles were not used.

[Evaluation Method]

The respective samples (the photosensitive members G-1 to H-1) were evaluated.

(Electrical Characteristics Evaluation)

Each sample (photosensitive member) was charged by a drum sensitivity test device manufactured by GEN-TECH, INC. at an initial charging of −800 V and a rotational speed of 31 rpm. Subsequently, the surface of the sample was irradiated with monochromatic light (wavelength: 780 nm, light quantity: 1.0 μJ/cm$^2$) extracted from light of a halogen lamp through a bandpass filter. Upon passage of 50 msec from the irradiation with monochromatic light, the surface potential (residual potential $V_L$) of the sample was measured. The measurement was carried out in an environment with a temperature of 23° C. and a humidity of 50% RH.

(Coefficient of Kinetic Friction)

Each sample (photosensitive member) was measured for the resistance value on the photosensitive layer surface, by using a beam-type load cell (WBU-10N, product of SHOWA MEASURING INSTRUMENTS CO., LTD.) and a polytetrafluoroethylene (PTFE) sheet (product of Sang-A Frontec Co., Ltd.) as pressing member. The measurements were performed under the load of 540 gf and the operation speed of 9 mm/sec. Then the resistance value thus measured was divided by the load to calculate an evaluation value (coefficient of kinetic friction) of the sample (photosensitive member).

(Abrasion Resistance Evaluation)

Each of the sample (photosensitive member) prepared in the above manner was evaluated for its abrasion resistance by evaluating an application liquid for forming a corresponding charge transport layer (in the explanation of the abrasion resistance evaluation, the application liquid is simply referred to as an "evaluation application liquid"). More specifically, the evaluation application liquid was applied onto a 0.3 mm-thick polypropylene sheet wound around an aluminum pipe measuring 78 mm in diameter, followed by drying at 120° C. for 40 minutes. As a result, an evaluation sheet was formed to a thickness of 30 μm on the polypropylene sheet.

Subsequently, the evaluation sheet was removed from the polypropylene sheet. The evaluation sheet thus removed was attached to a specimen mounting card (S-36, product of TABER Industries) to prepare a specimen.

Subsequently, the mass $M_A$ of the specimen before the abrasion test was measured. Then, the abrasion test was performed on the sample. More specifically, the specimen was set on a rotary table of a rotary ablation tester (Toyo Seiki Seisaku-sho, Ltd.). The rotary table was rotated for 1,000 times at a rotational speed of 60 rpm, with an abrasion wheel (CS-10, product of TABER Industries) placed on the sample to apply a load of 500 gf.

Subsequently, the mass $M_B$ of the specimen after the abrasion test was measured. Then, the abrasion loss ($=M_A-M_B$) was determined as a difference between the mass of the sample before and after the abrasion test.

(Appearance)

The entire surface region of each sample (photosensitive member) was observed under an optical microscope for the presence of solid foreign objects. The appearance of each sample (photosensitive member) was evaluated in accordance with the following criteria based on the size of the solid foreign objects observed.

Very Good: No foreign objects were observed.

Good: Two or less foreign objects having a major diameter of 0.2 mm were observed.

Acceptable: One foreign object having a major diameter of at least 0.2 mm and less than 0.3 mm was observed.

Poor: One or more foreign objects having a major diameter of 0.3 mm or more were observed.

Table 8 shows the evaluation results (electrical characteristics (sensitivity), coefficient of kinetic friction, abrasion resistance, and appearance) of the respective samples (photosensitive members G-1 to H-1).

TABLE 8

| Photo-Sensitive Member | Electrical Characteristics $V_L$ [V] | Coefficient of Kinetic Friction | Appearance Size [mm] | Appearance Number | Appearance Evaluation | Abrasion Resistance Abrasion Loss [mg] |
|---|---|---|---|---|---|---|
| G-1 | 75 | 0.19 | — | — | Very Good | 4.6 |
| G-2 | 72 | 0.19 | | | Very Good | 4.5 |
| G-3 | 73 | 0.18 | | | Very Good | 4.7 |
| G-4 | 75 | 0.20 | | | Very Good | 5.3 |
| G-5 | 66 | 0.20 | | | Very Good | 5.2 |
| G-6 | 68 | 0.21 | | | Very Good | 5.3 |
| G-7 | 75 | 0.19 | | | Very Good | 4.8 |
| G-8 | 74 | 0.19 | | | Very Good | 4.8 |
| G-9 | 76 | 0.18 | | | Very Good | 4.6 |
| G-10 | 65 | 0.19 | | | Very Good | 5.0 |
| G-11 | 75 | 0.19 | 0.25 | 1 | Acceptable | 5.0 |
| G-12 | 75 | 0.21 | — | — | Very Good | 5.1 |
| G-13 | 74 | 0.17 | — | — | Very Good | 4.7 |
| G-14 | 74 | 0.17 | 0.27 | 1 | Acceptable | 5.7 |
| G-15 | 75 | 0.20 | 0.16 | 2 | Good | 5.2 |
| G-16 | 75 | 0.19 | — | — | Very Good | 4.8 |
| G-17 | 73 | 0.19 | 0.24 | 1 | Acceptable | 5.1 |
| G-18 | 81 | 0.19 | 0.22 | 1 | Acceptable | 5.1 |
| G-19 | 75 | 0.14 | — | — | Very Good | 4.8 |
| G-20 | 74 | 0.16 | — | — | Very Good | 4.8 |
| G-21 | 75 | 0.21 | 0.17 | 1 | Good | 4.5 |
| G-22 | 73 | 0.23 | 0.19 | 2 | Good | 4.5 |
| G-23 | 76 | 0.19 | — | — | Very Good | 4.6 |
| G-24 | 75 | 0.25 | 0.24 | 1 | Acceptable | 5.4 |
| H-1 | 75 | 0.17 | — | — | Very Good | 9.8 |

As shown in Table 8, the photosensitive members G-1 to G-24 (the photosensitive members according to Examples of the present disclosure) each exhibited that the residual potential was no greater than 100 V, the coefficient of kinetic friction at the photosensitive layer surface was no greater than 0.25, that abrasion loss was no greater than 6.0 mg, and that the appearance was acceptable.

What is claimed is:

1. An electrophotographic photosensitive member comprising a photosensitive layer, wherein the photosensitive layer is a multi-layer photosensitive layer including a stack of a charge generating layer containing a charge generating material and a charge transport layer containing a phthalocyanine pigment, a charge transport material, a binder resin, and silica particles, the charge transport layer being an outermost layer, the charge transport material contains a compound represented by Formula CTM-10, and the silica particles are contained in the photosensitive layer in an amount of at least 0.5 parts by mass and no greater than 15 parts by mass relative to 100 parts by mass of the binder resin:

(CTM-10)

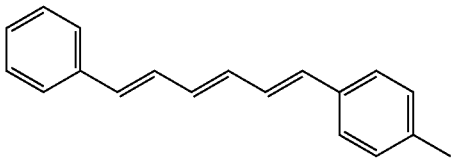

-continued

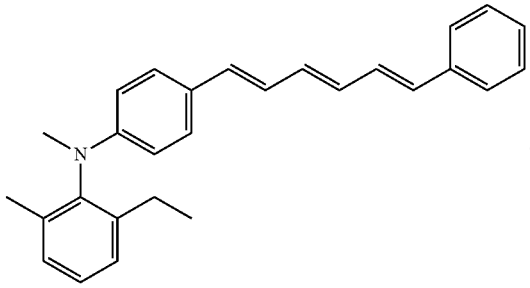

2. An electrophotographic photosensitive member according to claim 1, wherein the charge transport layer contains, as the charge transport material, a hole transport material and a compound represented by any one of General Formulae (1) to (3):

(1)

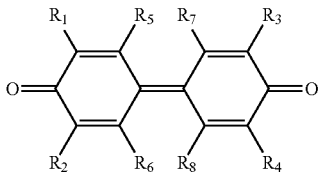

in General Formula (1), $R_1$ to $R_8$ each independently represent a hydrogen atom, an alkoxy group having 1 to 8 carbon atoms, a phenyl group, or an optionally substituted alkyl group having 1 to 8 carbon atoms, (2)

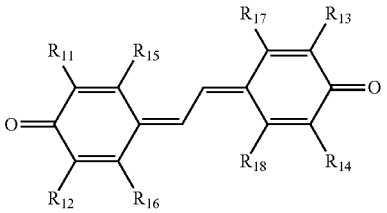

in General Formula (2), $R_{11}$ to $R_{18}$ each independently represent a hydrogen atom, an alkoxy group having 1 to 8 carbon atoms, a phenyl group, or an optionally substituted alkyl group having 1 to 8 carbon atoms, and (3)

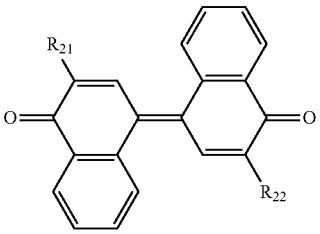

in General Formula (3), $R_{21}$ to $R_{22}$ each independently represent a hydrogen atom, an alkoxy group having 1 to 8 carbon atoms, a phenyl group, or an optionally substituted alkyl group having 1 to 8 carbon atoms.

3. An electrophotographic photosensitive member according to claim 1, wherein the charge transport layer contains a biphenyl derivative or a phenanthrene derivative.

4. An electrophotographic photosensitive member according to claim 3, wherein the biphenyl derivative or the phenanthrene derivative is a compound represented by any one of Formulae ADD-1 to ADD-8:

(ADD-1)

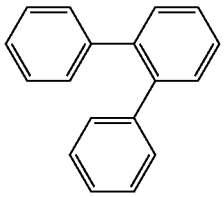

(ADD-2)

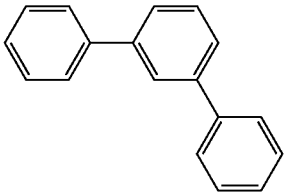

(ADD-3)

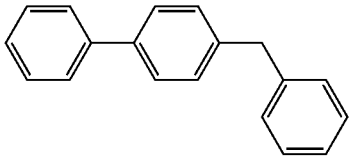

-continued (ADD-4)

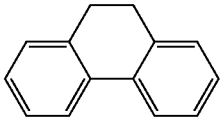

(ADD-5)

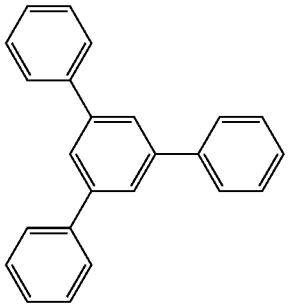

(ADD-6)

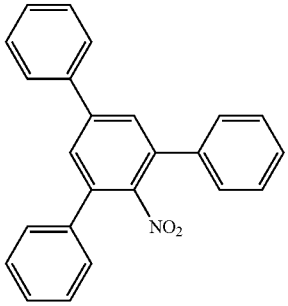

(ADD-7)

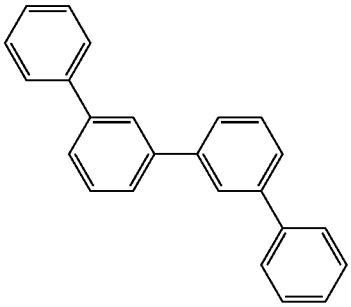

(ADD-8)

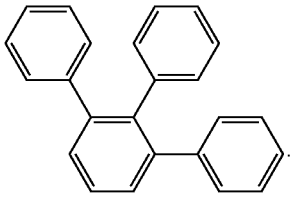

5. An electrophotographic photosensitive member according to claim 3, wherein the biphenyl derivative or the phenanthrene derivative contains a compound represented by any one of Formulae ADD-1 to ADD-4, ADD-6, and ADD-7:

(ADD-1)

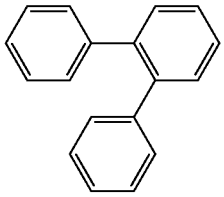

(ADD-2)

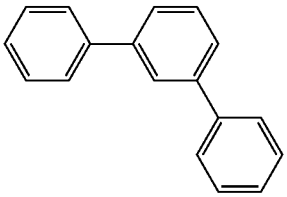

(ADD-3)

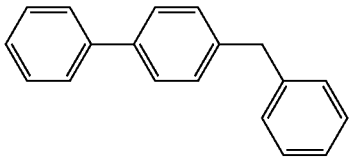

(ADD-4)

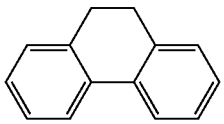

(ADD-6)

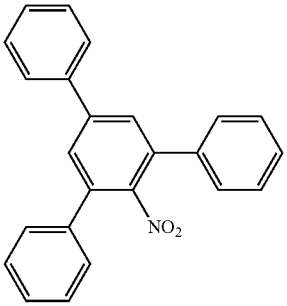

(ADD-7)

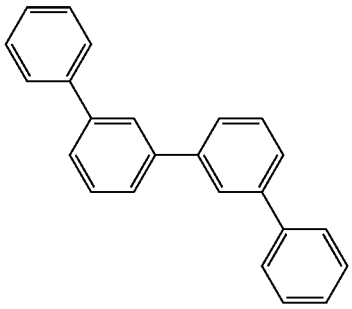

(ADD-3)

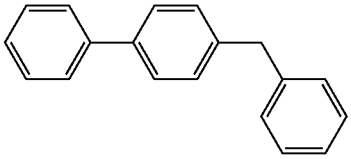

(ADD-4)

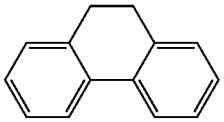

(ADD-6)

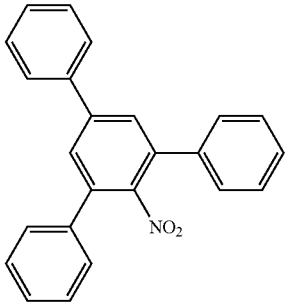

(ADD-7)

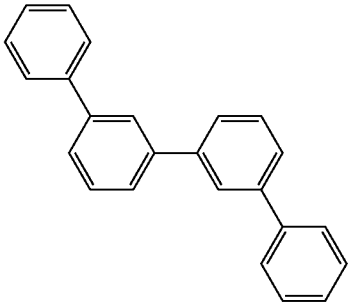

(ADD-8)

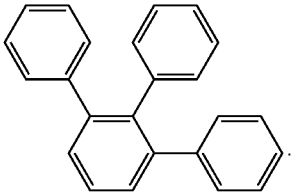

6. An electrophotographic photosensitive member according to claim 3, wherein the biphenyl derivative or the phenanthrene derivative contains a compound represented by any one of Formulae ADD-3, ADD-4 and ADD-6 to ADD-8:

7. An electrophotographic photosensitive member according to claim 1, wherein the phthalocyanine pigment is TiOPc that at least exhibits a peak at 27.2° among diffraction peaks at Bragg angles 2θ±0.2° with respect to characteristic X-rays of CuKα, TiOPc that at least exhibits a peak at 28.6° among diffraction peaks at Bragg angles 2θ±0.2° with respect to characteristic X-rays of CuKα, or a metal-free phthalocyanine.

8. An electrophotographic photosensitive member according to claim 1, wherein the photosensitive layer has a coefficient of dynamic friction of no greater than 0.25, and the charge transport layer contains a leveling agent.

9. An electrophotographic photosensitive member according to claim 8, wherein the leveling agent is a silicone oil having a siloxane backbone.

10. An electrophotographic photosensitive member according to claim 8, wherein the leveling agent is contained in an amount of at least 0.5 parts by mass and no greater than 0.9 parts by mass relative to 100 parts by mass of the binder resin.

11. An electrophotographic photosensitive member according to claim 1, wherein the silica particles have a surface treated with hexamethyldisilazane.

12. An electrophotographic photosensitive member according to claim 1, wherein the binder resin has a viscosity average molecular weight of at least 40,000.

13. An electrophotographic photosensitive member according to claim 1, wherein the charge transport layer contains, as the charge transport material, a hole transport material and a compound represented by Formula ETM-2:

(ETM-2)

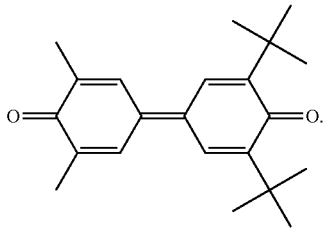

14. An electrophotographic photosensitive member according to claim 1, wherein the binder resin includes a resin represented by Formula Resin-5:

(Resin-5)

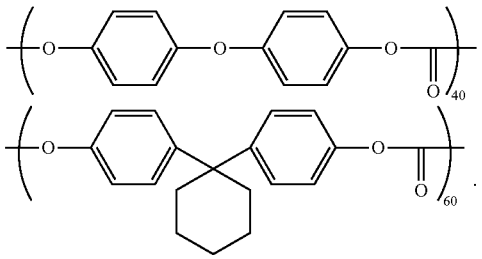

15. An electrophotographic photosensitive member according to claim 1, wherein the charge transport layer contains, as the charge transport material, a hole transport material and a compound represented by General Formula (2):

(2)

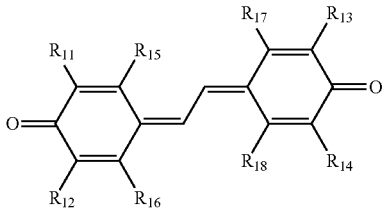

in General Formula (2), $R_{11}$ to $R_{18}$ each independently represent a hydrogen atom, an alkoxy group having 1 to 8 carbon atoms, a phenyl group, or an optionally substituted alkyl group having 1 to 8 carbon atoms.

16. An electrophotographic photosensitive member according to claim 1, wherein the charge transport layer contains, as the charge transport material, a hole transport material and a compound represented by either of Formulae ETM-3 and ETM-4:

(ETM-3)

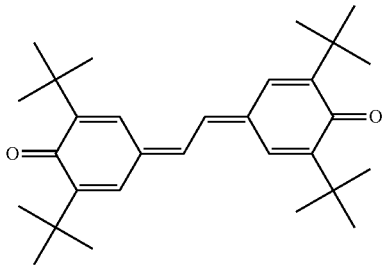

(ETM-4)

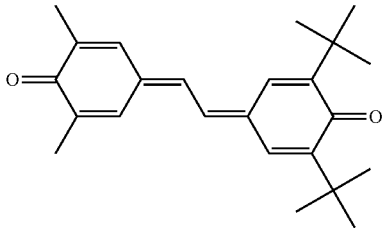

* * * * *